US005642603A

United States Patent [19]

Tanaka

[11] Patent Number: 5,642,603

[45] Date of Patent: Jul. 1, 1997

[54] METHOD AND APPARATUS FOR ACCOMMODATING GOODS IN CONTAINER

[75] Inventor: Nobuhiro Tanaka, Miyashiro-machi, Japan

[73] Assignee: Kao Corporation, Tokyo, Japan

[21] Appl. No.: 599,155

[22] Filed: Feb. 9, 1996

Related U.S. Application Data

[62] Division of Ser. No. 266,515, Jun. 27, 1994, Pat. No. 5,515,664.

[30] Foreign Application Priority Data

Jun. 30, 1993 [JP] Japan ..... 5-183171

[51] Int. Cl.[6] ..... B65B 35/30

[52] U.S. Cl. ..... 53/445; 53/154; 53/155; 53/237; 53/238; 53/247; 53/447; 53/474; 53/540; 414/789.2; 414/789.3; 414/789.6

[58] Field of Search ..... 414/789.2, 789.3, 414/789.6; 53/154, 155, 235, 237, 238, 243, 245, 247, 258, 260, 537, 538, 540, 542, 443, 445, 447, 448, 473, 474, 475

[56] References Cited

U.S. PATENT DOCUMENTS

| | | | |
|---|---|---|---|
| 1,977,497 | 10/1934 | Springer | 414/789.2 |
| 3,070,240 | 12/1962 | Barriol | 414/789.2 |
| 3,727,369 | 4/1973 | Lassig | 53/540 X |
| 4,195,737 | 4/1980 | Rysti | 414/789.6 X |

*Primary Examiner*—Daniel Moon

*Attorney, Agent, or Firm*—Oblon, Spivak, McClelland, Maier & Neustadt P.C.

[57] ABSTRACT

A goods accommodation method and apparatus in which a container is set such that its opening is directed horizontally, and box-shaped goods are stacked on a slide such that their surfaces facing the opening of the container are aligned with each other. The goods are transferred into the container while they are held in the stacked state by inserting the slide together with the goods stacked thereon into the container and then quickly pulling the slide out of the container at a speed higher than the speed of insertion such that the stacked goods remain in the container. The container is then turned up such that its opening is directed upward.

14 Claims, 18 Drawing Sheets

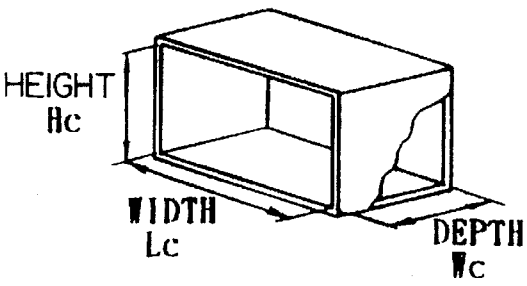
FIG. 14B
FIG. 14A
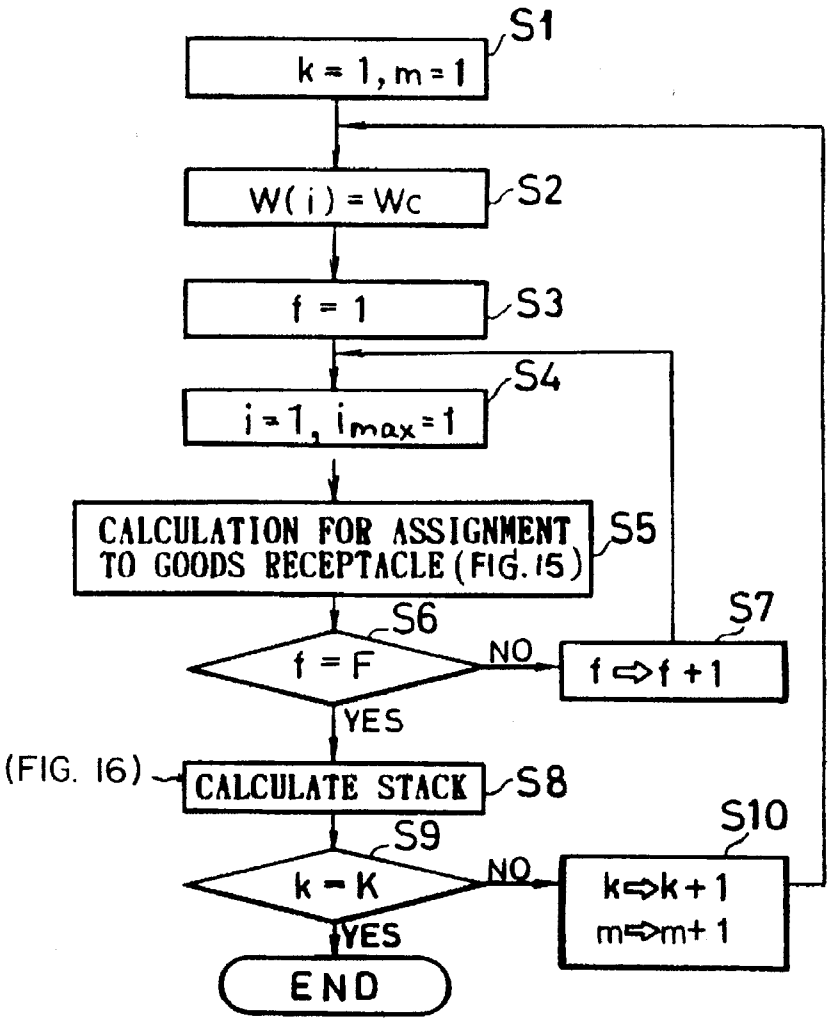

METHOD AND APPARATUS FOR ACCOMMODATING GOODS IN CONTAINER

This is a Division, of application Ser. No. 08/266,515 filed on Jun. 27, 1994 now U.S. Pat. No. 5,515,664.

BACKGROUND OF THE INVENTION

1. Field of the Invention

The present invention generally relates to a method and an apparatus for accommodating goods in a container, and in particular, for accommodating box-shaped goods in containers at goods distribution centers or the like.

2. Discussion of the Background

In the prior art, a goods accommodation method as shown in FIG. 20A is used, in which box-shaped goods 2 are accommodated in a container 1. In this method, the container 1 is set such that its opening is directed horizontally, and goods 2 are stacked on a stacking table 3 such that the container sides facing the opening of the container are aligned with each other. Then, the goods 2 are pushed with a pusher plate 4 into the container 1, and the container 1 is turned up such that its opening is directed upward.

In the prior art, however, when the goods 2 are pushed by the pusher plate 4 into the container 1, they are stopped at a position near the opening of the container 1. Therefore, when the container 1 is turned up, the goods 2 in the upper stage may fall as illustrated in FIG. 20A and may be crushed, or the state of the stack may be deformed.

SUMMARY OF THE INVENTION

The object of the present invention is to accommodate stacked goods in a container without deformation of the form of the stack.

According to a first embodiment of the invention, there is provided a goods accommodation method of accommodating box-shaped goods stacked in a plurality of stages one over another in a container while maintaining the state of the stack, by disposing the container such that the opening thereof is directed horizontally, stacking the box-shaped goods on a slide with the container side surfaces of the goods aligned, then transferring the goods in the stacked state into the container by inserting the slide together with the goods stacked thereon into the container and then quickly pulling the slide outwardly of the container, and turning up the container such that the opening thereof is directed upward.

According to a second embodiment of the invention, there is provided a goods accommodation apparatus for accommodating box-shaped goods stacked in a plurality of stages one over another in a container while maintaining the state of the stack, comprising a container position changing unit for changing the container position between a position, at which the opening of the container is directed horizontally, and a position, at which the opening of the container is directed upward, a slide for supporting box-shaped goods placed thereon in a stacked state, and a slide drive unit for causing the slide to be advanced into and retreated out of the container through the opening thereof directed horizontally, the speed of movement of the slide out of the container being capable of being set to be higher than the speed of movement of the slide into the container.

According to a third embodiment of the invention, the goods accommodation apparatus as recited in the second embodiment has the slide inclined downward toward the inside of the container.

According to a fourth embodiment of the invention, the goods accommodation apparatus as recited in the second embodiment further comprises a goods return prevention member for closing the opening of the container when the slide is moved out of the container.

According to a fifth embodiment of the invention, there is provided a goods accommodation method of successively receiving box-shaped goods delivered from a plurality of goods delivery units in necessary quantities on a plurality of goods receptacles in a stacked form in a container by using as each of the goods receptacles one having a goods reception surface inclined downward from a goods reception side toward the other side, the goods receptacle including a side wall provided on the other side for stopping received goods and causing the goods received on the goods receptacle to gather on the goods reception surface such as to be on the side thereof adjacent the side wall.

According to a sixth embodiment of the invention, there is provided a goods accommodation apparatus for successively receiving box-shaped goods delivered from a plurality of goods delivery units in necessary quantities on a plurality of goods receptacles and accommodating the goods on the goods receptacles in a stacked form in a container, each of the goods receptacles having a goods reception surface inclined downward from a goods reception side toward the other side, the goods receptacle including a side wall provided on the other side for stopping received goods.

According to a seventh embodiment of the invention, there is a goods accommodation method of successively receiving box-shaped goods delivered from a plurality of goods delivery units in necessary quantities on respective goods receptacles, stacking the goods into a stack having a plurality of stages one over another and accommodating the goods in the stacked state in a container, comprising a collecting step of collecting goods received on each goods receptacle by causing the goods to gather on the goods reception surface such as to be on the side thereof adjacent on a movable side wall in a closed state by using one or more goods receptacles each having a goods reception surface inclined downward from a goods reception side toward the other side, the goods receptacle including a movable side wall for opening and closing a side zone on the other side, a shutter disposed side-wise of the goods receptacle and including a shutter member capable of position change between a tilted position, at which goods delivered from the goods receptacle are received, and a horizontal position, at which goods are delivered, the shutter member being opened at the horizontal position thereof to permit delivery of goods, and a table unit disposed beneath the shutter and including a stacking table with a slide thereon, the stacking table being for supporting goods delivered from the shutter and also being capable of being raised and lowered to stack goods delivered from the shutter on goods delivered earlier on the slide on the stacking table, a transferring step of opening the movable side wall of the goods receptacle to cause sliding of the goods on the goods reception surface o as to effect transfer of goods onto the shutter member of the shutter having substantially the same slope of inclination as that of the goods reception surface, and a stacking step of stacking the goods on the slide in a state with the container side surfaces of the goods aligned on the slide on the stacking table of the table unit by bringing the shutter member of the shutter to be horizontal and thus opening the shutter member, the collecting, transferring and stacking steps being carried out repeatedly to collect goods in a vertical stack of a plurality of stages on the slide on the stacking table, the container being set such that the opening thereof is directed horizontally, the goods being transferred in the stacked state into the container by inserting the slide together with the goods stacked thereon into the container and then pulling the slide quickly out of the container, the container being subsequently turned up such that the opening thereof is directed upward.

According to the eighth embodiment of the invention, there is provided a goods accommodation apparatus of successively receiving box-shaped goods delivered from a plurality of goods delivery units in necessary quantities on respective goods receptacles, stacking the goods into a stack having a plurality of stages one over another and accommodating the goods in the stacked state in a container, comprising one or more goods receptacles each having a goods reception surface inclined downward from a goods reception side toward the other side, the goods receptacle including a movable side wall for opening and closing a side zone on the other side, a shutter disposed side-wise of the goods receptacle and including a shutter member capable of position change between a tilted position, at which goods delivered from the goods receptacle are received, and a horizontal position, at which goods are delivered, the shutter member being opened at the horizontal position thereof to permit delivery of goods, a table unit disposed beneath the shutter and including a stacking table with a slide thereon, the stacking table being for supporting goods delivered from the shutter and also being capable of being raised and lowered to stack goods delivered form the shutter on goods delivered earlier on the slide on the stacking table, a container position change unit capable of changing the container position between a position, at which the container opening is directed horizontally, and a position, at which the container opening is directed upward, and a slide drive unit for causing advancement and retreat of the slide into and out of the container through the opening thereof in the horizontally directed state, the speed of movement of the slide out of the container being capable of being set to be higher than the speed of movement of the slide into the container.

According to the first and second embodiments of the invention, the following function (1) is obtainable:

(1) After goods have been stacked on the slide, by inserting the goods together with the slide into the container up to a position near the bottom of the container and then pulling out the slide alone, the goods can be transferred while maintaining their stacked state into the container near the bottom thereof. Since at this time the goods are stacked with their container bottom side surfaces aligned, the goods in all the stages can be brought to a position in close proximity of the container bottom. Thus, when the container is subsequently turned up, the goods in all the stages can be immediately supported on the container bottom such that they are left thereon with their bottom side surfaces aligned and without deformation of their stacked form. Thus, the stacked goods can be accommodated in the container without deformation of their stack.

According to the third embodiment of the invention, the following function (2) is obtainable:

(2) With the slide inclined downward toward the depth of the container, when pulling out the slide having been inserted into the container, the goods may be readily separated from the slide and remain on the side of the container bottom, so that it is possible to prevent the goods from being pulled back together with the slide out of the container.

According to the fourth embodiment of the invention, the following function (3) is obtainable:

(3) By using the goods return prevention member for closing the container opening when the slide is moved out of the container, if the goods are going to be pulled back along with the slide out of the container when the slide is pulled back, the goods can be checked so that they will not get out of the container. This function is particularly useful when the quantity of goods involved is large.

According to the fifth and sixth embodiment of the invention, the following function (4) is obtainable:

(4) Goods which are delivered from the goods delivery unit and transferred to the goods receptacle are allowed to slide along the inclined goods reception surface to be stopped and received by the movable side wall held in the closed state at the lower end of the inclined goods reception surface such that they are given a predetermined goods collection form with one side thereof defined by the movable side wall (FIGS. 17A and 17B).

Succeeding goods are also allowed to slide along the inclined goods reception surface to be received on the side of the lower end of the inclined goods reception surface such that they are given a predetermined goods collection form with one side thereof defined by the corresponding side of the earlier goods held stationary in the predetermined goods collection form of arrangement (FIGS. 17A and 17B).

Thus, the goods which are transferred successively are received stably such that they are allowed to gather against the movable side wall. It is thus possible to highly densely collect goods on the goods reception surface such that they are aligned in a predetermined goods collection form.

According to the seventh and eighth embodiment of the invention, the following function (5) is obtainable:

(5) Goods delivered from the goods delivery unit are transferred onto two or more goods receptacles. When subsequently accommodating the goods supported on the individual goods receptacles in the container, goods are highly densely collected on the first goods receptacle with the function (4) noted above, and then goods are highly densely collected on the second goods receptacle with the function (4) (FIGS. 18A and 18B).

With the opening of the movable side wall, the goods having been collected on the first goods receptacle which are aligned in a predetermined goods collection form, are transferred without deformation of their collection form from the inclined goods reception surface onto the shutter member having substantially the same slope of inclination. Then, the shutter member is made horizontal and opened to transfer the goods onto the stacking table without deformation of the predetermined collection form of the goods (FIG. 18D).

With the next opening of the movable side wall, the goods which are collected on the second goods receptacle aligned in the predetermined goods collection form, are transferred without deformation of their collection form from the inclined goods reception surface onto the shutter member with substantially the same slope of inclination. Then, the shutter member is made horizontal and opened to stack the goods without deformation of the predetermined goods collection form on the goods that have already been transferred onto the stacking table (FIGS. 18D and 18E). At this time, the lower goods are arranged without any intervening gap between adjacent ones of them, and thus it is possible to stack goods on the earlier goods without deformation of the collection form.

The goods which are thus stacked on the stacking table can be accommodated without deformation of the predetermined goods collection form, i.e., in the stacked state, in the container with the above functions (1) to (3). In this way, it is possible to accommodate goods in the container in a highly dense manner.

BRIEF DESCRIPTION OF THE DRAWINGS

A more complete appreciation of the invention and many of the attendant advantages thereof will be readily obtained as the same become better understood by reference to the following detailed description when considered in connection with the accompanying drawings, wherein:

FIG. 14A is a flow chart of a routine for the assignment of goods receptacles and containers to individual customers with respect to all kinds of ordered goods;

FIG. 14B illustrates the dimensions of a container;

DESCRIPTION OF THE PREFERRED EMBODIMENT

Figure 1:
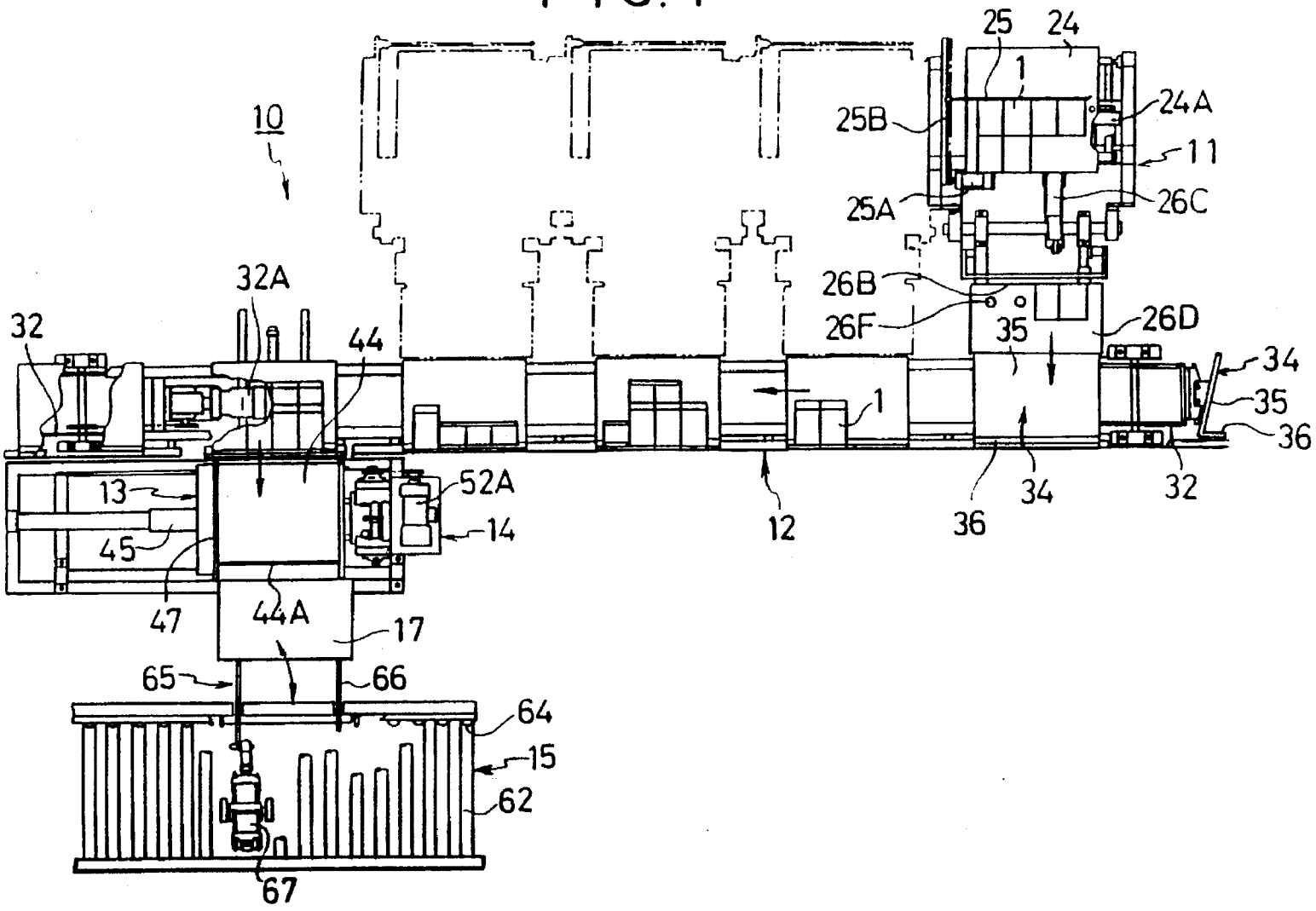
FIG. 1 is a schematic plan view showing the layout of a goods collection apparatus according to the invention.

Referring now to the drawings, wherein like reference numerals designate identical or corresponding parts throughout the several views, and more particularly to FIG. 1 thereof, there is shown a goods collection apparatus generally designated at 10, which comprises a goods delivery unit 11, a goods reception conveyor 12, a shutter 13, a table unit 14 and a container conveyor 15. The goods delivery unit 11 of the apparatus 10 delivers box-shaped goods 1 in necessary quantities to one or more goods receptacles 34, which are provided on the goods reception conveyor 12. Goods which are collected on the goods reception conveyor 12 for each customer are transferred for stacking to the table unit 14 via the shutter 13. Goods which are stacked on the table unit 14 for each customer are accommodated and conveyed in a container 17 on the side of the container conveyor 15.

Now, the goods delivery unit 11, goods reception conveyor 12, shutter 13, table unit 14 and container conveyor 15 will be described in detail.

Figure 2:
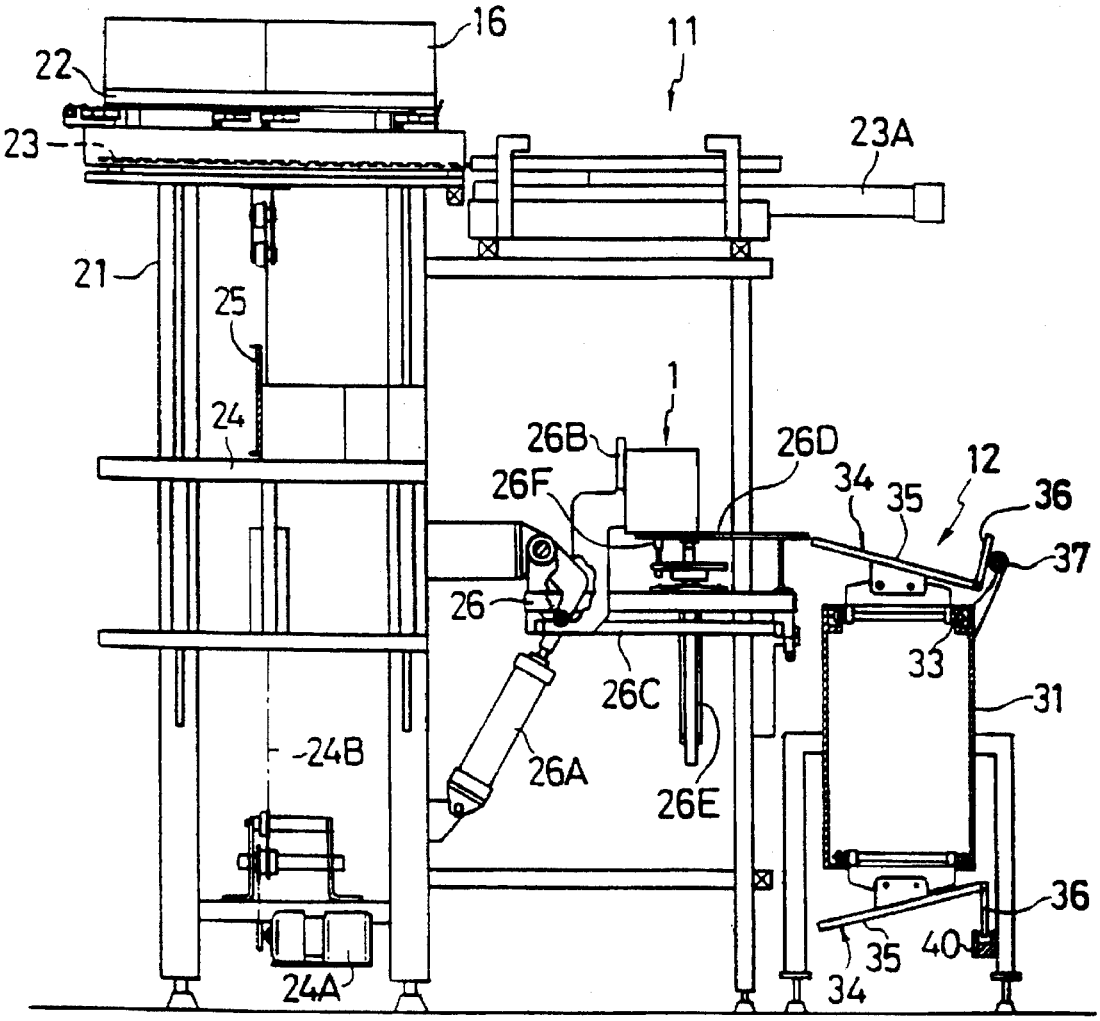
FIG. 2 is a front view showing a goods delivery unit and a goods reception conveyor.

(A) Goods delivery unit 11 (detailed in FIG. 2)

In the goods collection apparatus 10, a plurality of goods delivery units 11 are provided in parallel at respective positions along the conveying line of the goods reception conveyor 12. The individual goods delivery units 11 can deliver different kinds (or the same kind) of goods 1 (1A, 1B, . . . ).

Each goods delivery unit 11 includes a rack 21 provided at the top with a cardboard box support 22, on which one or more cardboard boxes 16 is placed. Beneath the cardboard box support 22, a shutter member 23 is provided such that it can be opened and closed. Beneath the shutter member 23, a lift table 24 is provided such that it can be raised and lowered. The shutter member 23 is driven for opening and closing by a piston-cylinder assembly 23A. The lift table 24 is coupled to and driven for raising and lowering by a chain 24B which is driven by a lift motor 24A.

The cardboard 16 with goods 1 therein is placed, with its lid removed and its opening directed down, on the cardboard box support 22 by a robot or the like, and goods 1 in the cardboard box 16 are supported on the shutter member 23 in the closed state. The lift table 24 is raised and lowered between a position at which goods are transferred to a delivery table 26D to be described later, and a position at which goods are received from the shutter member 23. With the lift table 24 at its upper goods reception position, the shutter member 23 is opened, whereby the goods 1 in the cardboard box 16 supported on the shutter member 23 are transferred onto the lift table 24.

Behind the lift table 24 at the goods delivery position, a pusher plate 25 is moved along the top surface of the lift table 24 to bring the front side of the goods 1 on the lift table 24 to the front edge thereof (i.e., to a position, at which the goods 1 can be in contact with the delivery table 26D). The pusher plate 25 is coupled to and driven by a chain 24B which is driven by a motor 25A.

On the front side of the lift table 24 at the goods delivery position, a delivery base 26 is supported for swinging over a span of 90 degrees. The delivery base 26 is driven for swinging by a piston-cylinder assembly 26A. The delivery base 26B has a goods support member 26B, which is flush with the lift table 24 at the goods delivery position and is slidingly driven by a piston-cylinder assembly 26C. The delivery table 26D noted above is disposed at 90 degrees with respect to the goods support member 26B and is driven for advancement and retraction by a piston-cylinder assembly 26E. It carries a suction pad 26F.

When the delivery base 26 is brought to its upright position, the goods support member 26B is set to be flush with the lift table 24 at the goods delivery position. In this state, the delivery table 26D and suction pad 26F are advanced by the piston-cylinder assembly 26E, whereby the front side of the forward row of goods 1 on the lift table 24 is sucked to the suction pad 26F. Then, the delivery table 26D and suction pad 26F are retracted by the piston-cylinder assembly 26E whereby the above goods 1 that have been sucked to the suction pad 26F are withdrawn to the goods support member 26B. Then, the delivery table 26 is set to its horizontal position, whereby the goods 1 are supported on the delivery table 26D. In this state, the suction by the suction pad 26F is released, and, the goods support member 26B is advanced by the piston-cylinder assembly 26C. As a result, the goods 1 are pushed by the goods support member 26B to slide over the delivery table 26D and delivered to the side of, the goods reception conveyor 12.

Thus, the goods delivery unit 11 delivers with its pusher plate 25 the goods 1 of the kind which is assigned to it from the forward row from the lift table 24 via the delivery table 26D to the side of the goods reception conveyor 12. The individual goods delivery units 11 deliver different kinds (or the same kind) of goods 1 in necessary quantities to the same goods receptacle 34 or different goods receptacles 34 on the goods reception conveyor 12.

Figure 3:
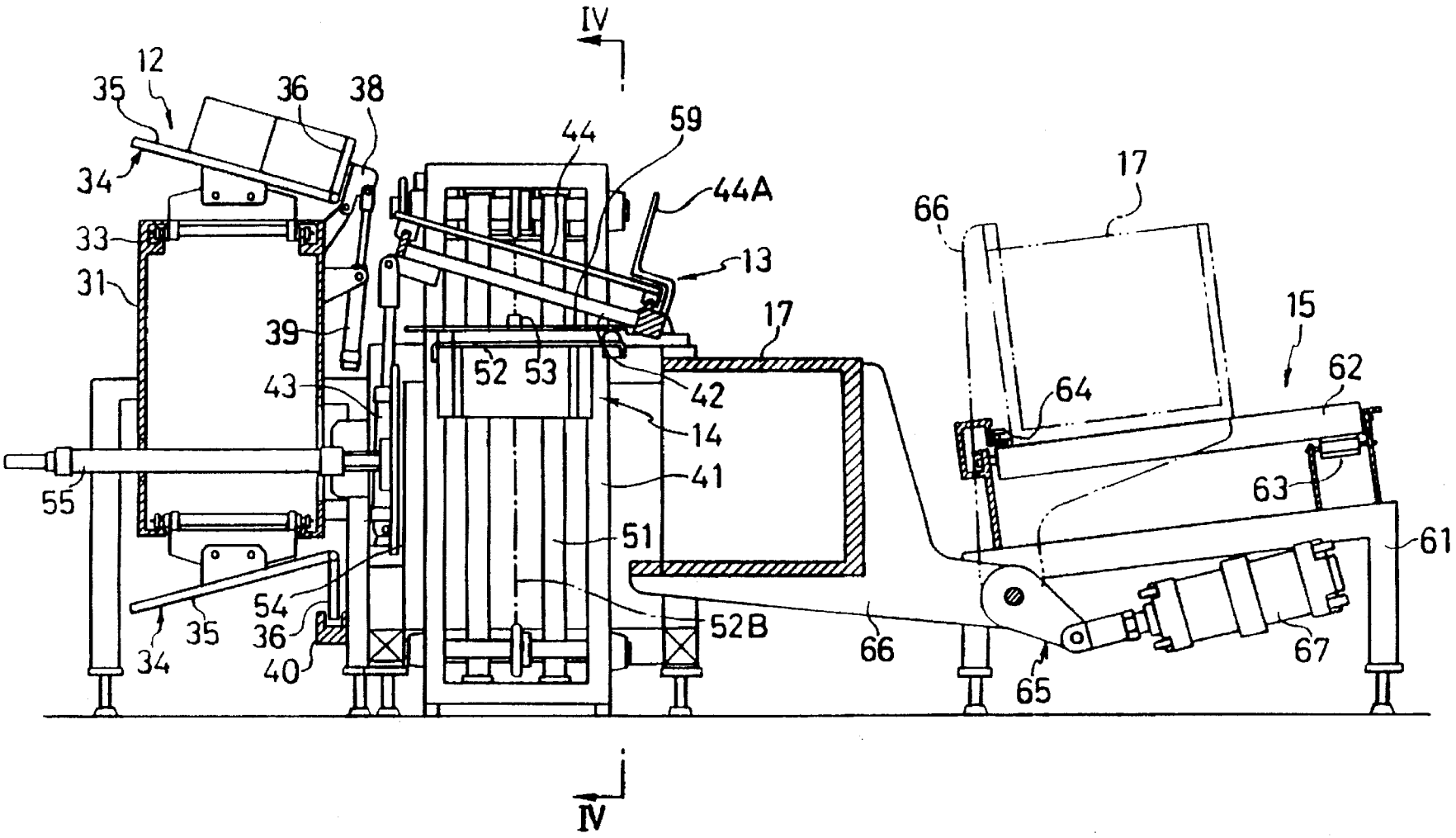
FIG. 3 is a front view showing the goods reception conveyor, a shutter, a table unit and a container conveyor.

(B) Goods reception conveyor (FIGS. 1 to 3)

The goods reception conveyor 12 includes a rack 31 provided at opposite ends thereof with sprocket wheels 32, round which an endless chain 33 is passed. One of the sprocket wheels 32 can be driven from a motor 32A. The goods reception conveyor 12 has a plurality of goods receptacles 34 which are mounted at a predetermined pitch on the chain 33. Each goods receptacle 34 has a goods reception surface 35, which is inclined downwardly from a goods reception side nearer the goods delivery unit 11 (see FIG. 2) toward the other side nearer the shutter 13 (see FIG. 3) (i.e. in the direction perpendicular to the conveying direction of the goods reception conveyor 12). On the other side noted above, a movable side wall 36 is provided for opening and closing a lower end zone of the goods reception surface 35 in the inclined direction.

In the upper run of the conveying line of the goods reception conveyor 12, the movable side wall 36, (a) is held in its upright closing position by a side wall guide 37, which is mounted on the rack 31 and extends in the direction of the conveying line noted above, to be ready for stopping and receiving goods 1 to the shutter 13 and (b), in the position of goods delivery to the shutter 13, can be opened and closed by a side wall stopper 38 which is pivoted to the rack 31. The side wall stopper 38 is swingably driven by a tilt piston-cylinder assembly 39 mounted on the rack 31 to switch the side wall guide 37 between a closing position, at which the guide 37 is at the same angle as in (a) above, and an opening position, at which the guide is at the same angle as the angle of inclination of the goods reception surface 35.

More specifically, goods 1 delivered from each goods delivery unit 11 in the manner as in (a) above, are received on the goods reception surface 35 of a corresponding goods receptacle 34 on the goods reception conveyor 12. The goods 1 received on the goods reception surface 35 slide along the slope thereof to be stopped by the movable side wall in the closed state, and thus they are received in a predetermined collection form with one side thereof defined by the movable side wall 36. Succeeding goods 1 which are also delivered from each goods delivery unit 11 to the goods reception surface 35 of the goods receptacle 34, also slide along the slope of the goods reception surface 35 and are thus received in a predetermined collection form with one side thereof defined by one side of the goods that have already been received.

In the tower run of the conveying line of the goods reception conveyor 12, the movable side wall 36 is moved along a groove formed in a side wall reception member 40, which is mounted on the rack 31 and extends in the conveying direction, to prevent lateral vibrations.

Figure 4:
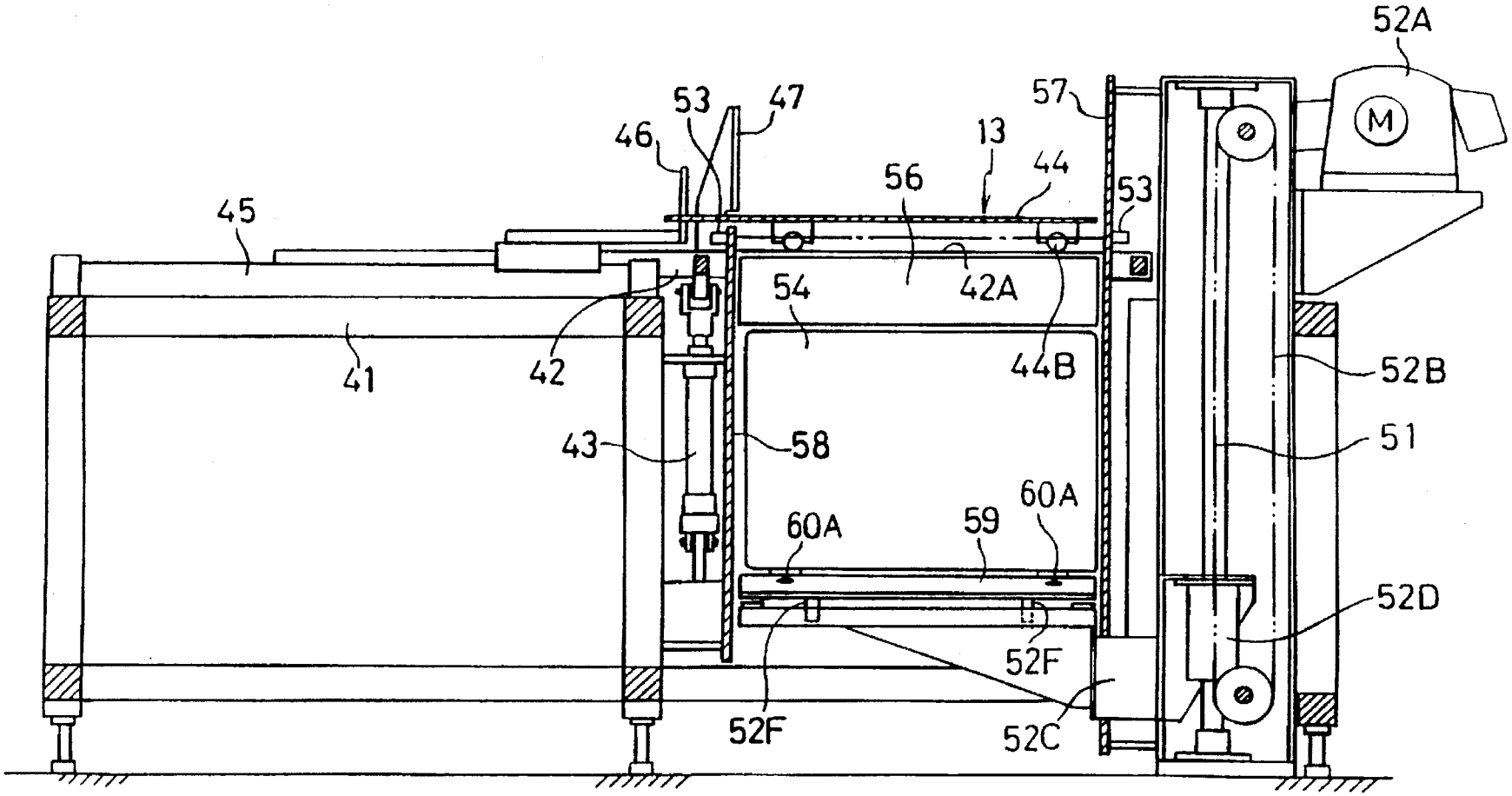
FIG. 4 is a sectional view taken along line IV—IV in FIG. 3.

(C) Shutter 13 (FIGS. 1, 3 and 4)

The shutter 13 is disposed side-wise (along a side) of the position of each goods receptacle 34 on the goods reception conveyor 12. The shutter 13 includes a rack 41, on which a tilt frame 42 is mounted for tilting by a tilt piston-cylinder assembly 43. The shutter 13 also includes a shutter member 44 which is movable along guide rails 42A provided on the tilt frame 42 between a closing position and an opening position. An upright stopper member 44A is provided on the side of the shutter member 44 opposite the goods reception conveyor, i.e., on the side of the lower end of the shutter member 44 in the tilted state. Designated as 44B are wheels. The shutter member 44 is driven by an opening/closing piston-cylinder assembly 45 between the closing and opening positions noted above. The piston rod of the opening/closing piston-cylinder assembly 45 has a pin 46 provided at its end. A coupling hole provided in the shutter member 44 is engaged on the pin 46.

In the shutter 13, the tilting of the tilt frame 42 caused by the tilt piston-cylinder assembly 43 causes a position change of the shutter member 44 between a tilted and a horizontal position. In its tilted position, the shutter member 44 has substantially the same slope of inclination as that of the goods reception surface 35 of the goods receptacle 34, so that goods 1 delivered from the goods reception surface 35 with the opening of the movable side wall 36 are stopped by the reception stopper 44A without deformation of their collection form on the goods reception surface 35. At this time, the shutter member 44 is in its closed position.

In its horizontal position, the shutter member 44 of the shutter 13 is brought to its open position by the opening/closing piston-cylinder assembly 45, whereby goods 1 that have been received on it can be delivered to the lower table unit 14.

In the shutter 13, the tilt frame 42 has a scraper 47. The scraper 47 is set on the side of the opening/closing piston-cylinder assembly 45 of the shutter member 44, and when the shutter member 44 is opened, it stops goods 1 on and moved by the shutter member 44.

At this time, the movable side wall 36 of the goods receptacle 34 and the scraper 47 of the shutter 13 are adapted to perpendicularly stop the sides of the goods 1. More specifically, when the goods 1 are received on the goods reception surface 35 of the goods receptacle 34, their X direction position is regulated with one side defined by the movable side wall 36, and when they are subsequently delivered from the shutter member 44 of the shutter 13, their Y direction position is regulated with another side of them pushed against the scraper 47. Thus, they are delivered in their collection form aligned in both the X and Y directions to the side of the table unit 14.

Figure 19:
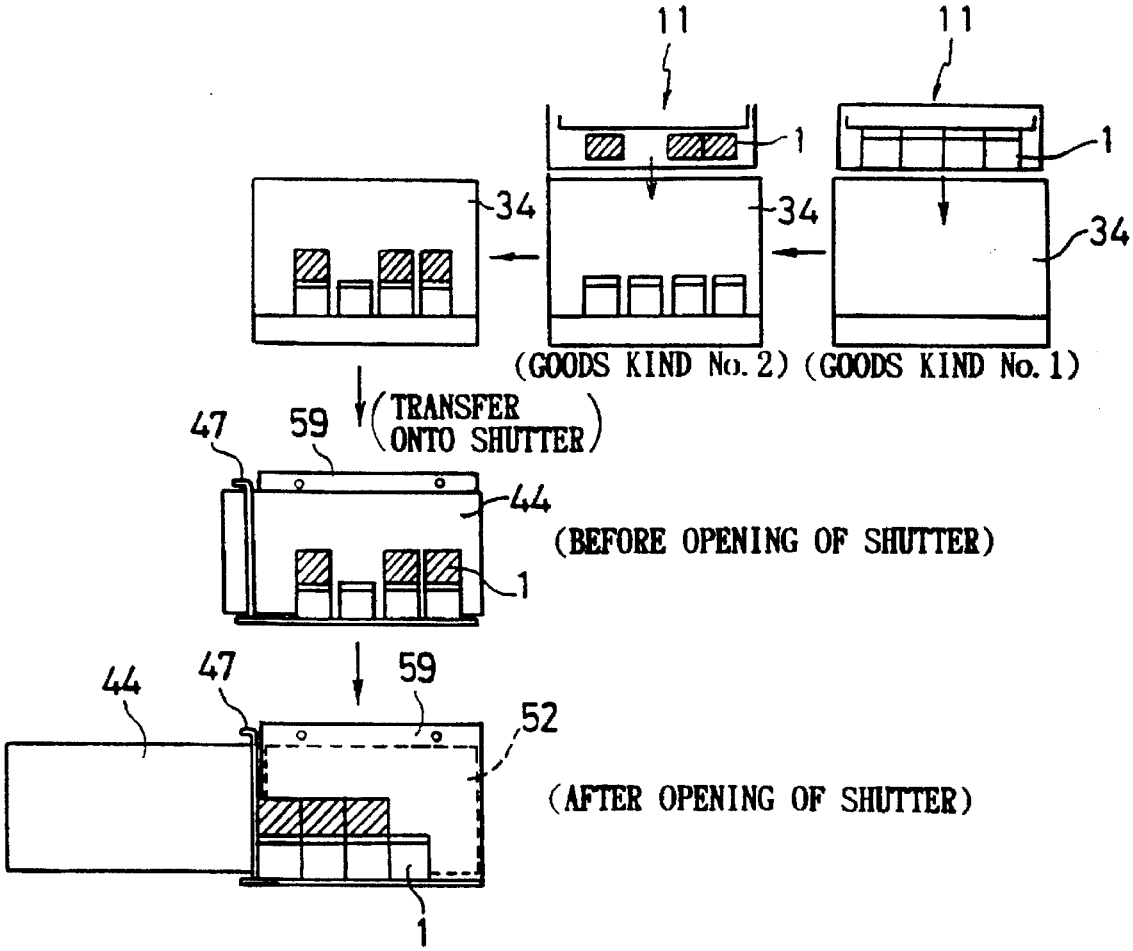
FIG. 19 is a schematic illustration of a compacting function of a scraper.

The scraper 47 further has the following function. As shown in FIG. 19, the goods that are on the shutter member 44 before the opening thereof are such that some of them are missing depending on the stock state of the goods delivery unit 11, adjacent ones of them are arranged loosely with an intervening gap therebetween as a result of a shock produced at the time of the reception, and/or they are in the neighborhood of the center of the goods receptacle 34. Even when the goods are spaced apart from the scraper 47 on the shutter member 44 or arranged loosely with an intervening gap between adjacent ones of them, with the opening of the shutter member 44, they are moved therewith and gather toward the scraper 47 so that they can be arranged compactly without any intervening gap between adjacent ones of them with the scraper 47 as a reference. Succeedingly delivered goods thus can be stacked with stability onto these goods. The succeeding goods are also made compact by the action of the scraper 47.

(D) Table unit (FIGS. 1, 3 and 4)

The table unit 14 is disposed beneath the shutter 13. It includes two upright lift guides 51, 51 provided on the side of the rack 41 noted above opposite the opening closing piston-cylinder assembly of the shutter member 44. On the lift guides 51, 51, a table support member 52C which is integral with a stacking table 52 is cantilevered for raising and lowering. The stacking table 52 is coupled to a chain 52B driven by a lift motor 52A, and thus it can be raised and lowered between a lower and an upper set position. Designated at 52D is a linear bearing.

Figure 12:
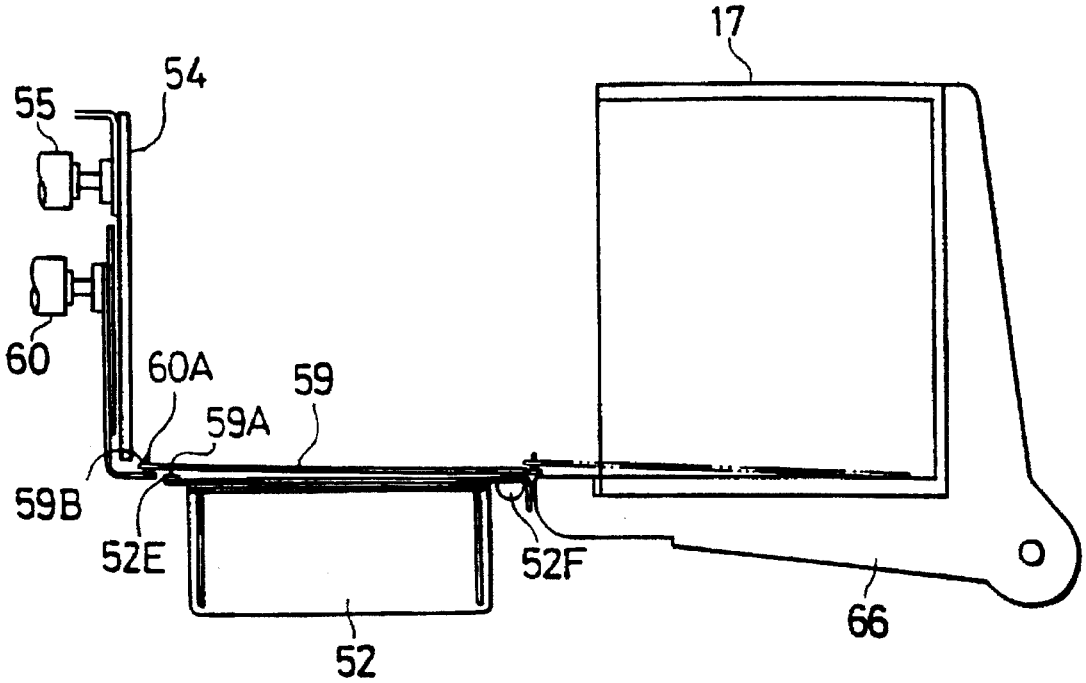
FIG. 12 is a schematic view showing a slide and a slide drive unit.

The stacking table 52, as shown in FIG. 12, includes a slide 59, which is placed on a table surface provided on the side of the front edge with engagement pins 52E and on the side of the rear edge with wheels 52F. The slide 59 is substantially at the same level as the table surface of the stacking table 52, and the underside of its front edge is placed on the wheels 52F while it is positioned with its engagement holes 59A formed adjacent the rear edge on the engagement pins 52F of the stacking table 52. Where the goods 1 are made of paper or film-coated paper, the slide 59 is made from a Teflon sheet or other low friction material.

In its lower set position, stacking table 52 is stopped with the slide 59 at the same level as the lowermost surface of a horizontally directed container 17 on the side of the container conveyor 15. In its upper set position, the stacking table 52 is stopped at a level, at which an optical sensor 53 provided on the rack 41 detects that the stacking table 52 on the slide 59 is empty or detects the uppermost surface of goods 1 on the slide 59 on the stacking table 52. Thus, the stacking table 52 and the slide 59 wait at the upper set position without interference from the shutter member 44 of the shutter 13. Alternatively, the upper set position of the stacking table 52 may be determined from the calculation of the upper most surface level of product from the product size.

Thus, in the table unit 14, the stacking table 52 supporting goods 1 delivered from the shutter 13 can be raised and lowered for stacking the goods 1 successively on goods 1 that have already been delivered from the shutter 13 to the slide 59 on the stacking table 52. Whenever goods 1 are stacked vertically, the stacking table 52 is lowered again in response to the detecting operation of the optical sensor 53. When a stack of a predetermined number of layers is completed, the stacking table 52 is lowered down from the slide 59 to and stopped at its lower set position which is a level for accommodating goods in the container 17.

The table unit 14, as shown in FIG. 12, includes a slide drive piston-cylinder assembly 60 (i.e., a slide drive unit) for transferring goods 1 on the slide 59 on the stacking table 52 at the lower set position thereof to the container 17. The slide drive piston-cylinder assembly 60 has engagement pins 60A, which are adapted to be fitted upward in engagement holes 59B provided in the slide 59 adjacent the trailing edge thereof. When the slide drive piston-cylinder assembly 60 is in its retreated position (i.e., initial position), the engagement pins 60A are waiting for the lowering of the engagement holes 59B of the slide 59 on the stacking table 52, and when the stacking table 52 reaches the lower set position, they are naturally engaged in the engagement holes 59B. When the engagement holes 59B are brought into engagement on the engagement pins 60A, the edge of the slide 59 on the side of the engagement holes 59B is slightly raised relative to the other or front edge, and thus the slide 59 is inclined downward toward the inside of the container 17. With advancement or retreat of the slide drive piston-cylinder assembly 60 caused in this state, the slide 59 is advanced or retreated into or out of the container 17 through the horizontally directed opening thereof by sliding over the wheels 52F of the stacking table 52.

Figure 13:
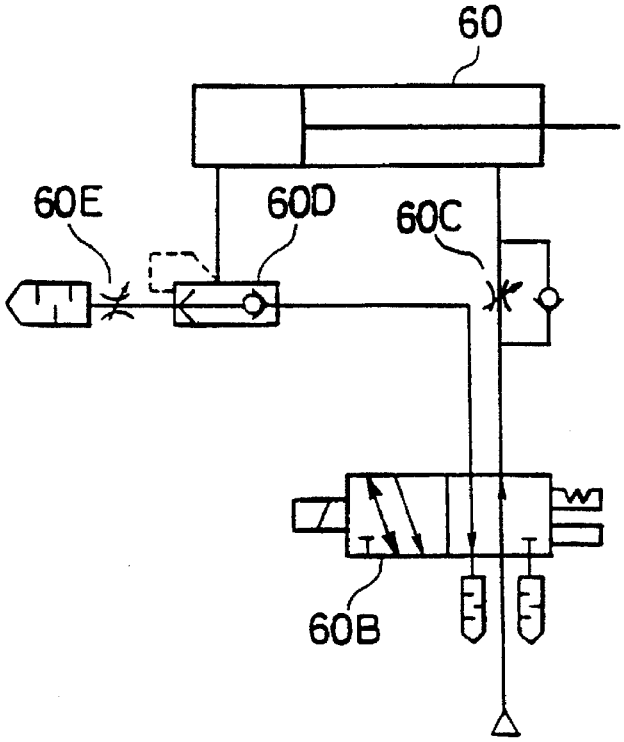
FIG. 13 is a circuit diagram showing a pneumatic circuit of the slide drive unit.

The slide drive piston-cylinder assembly 60 is driven for movement by a pneumatic circuit as shown in FIG. 13. Referring to FIG. 13, designated at 60B is a change-over valve, at 60C is a throttle, at 60D is a high speed exhaust valve, and at 60E is a throttle. The slide drive piston-cylinder assembly 60 functions such that (a) when causing the advancement of the slide 59 into the container 17, it provides for a low speed of movement of the slide 59 with a resistance of the throttle 60C offered against the flow of exhaust air through the throttle 60C and change-over valve 60B and that (b) when causing the retreat of the slide 59 out of the container 17, it provides for a high speed of movement of the slide 59 without offering great resistance against the flow of exhaust gas through the high speed exhaust valve 60D and throttle 60E (with the throttle 60E held substantially fully open). That is, the slide drive piston-cylinder assembly 60 sets the speed of retreat of the slide 59 out of the container 17 to be higher than the speed of advancement of the slide into the container. Thus, in the table unit 14, the goods 1 can be transferred into the container 17 while they are held in the stacked state as the slide 59 with the goods 1 stacked thereon is inserted together therewith into the container and then the slide 59 is quickly pulled out of the container 17.

The table unit 14 includes a goods return prevention member 54 for closing the opening of the container 17 when the slide 59 is moved out of the container 17. The goods return prevention member 54 is driven by a goods return prevention member piston-cylinder assembly 55. The goods return prevention member drive piston-cylinder assembly 55 causes advancement of the goods return prevention member 54 toward the container 17 simultaneously with the advancement of the slide 59 caused by the slide drive piston-cylinder assembly 60. When the piston-cylinder assembly 60 causes quick retreat of the slide 59, the assembly 55 holds the goods return prevention member 54 in front of the opening of the container 17 and, a certain delay time after the operation of the above retreat of the slide 59, it causes retreat of the goods return prevention member 54 to the retreated position (i.e., initial position).

Figure 5:
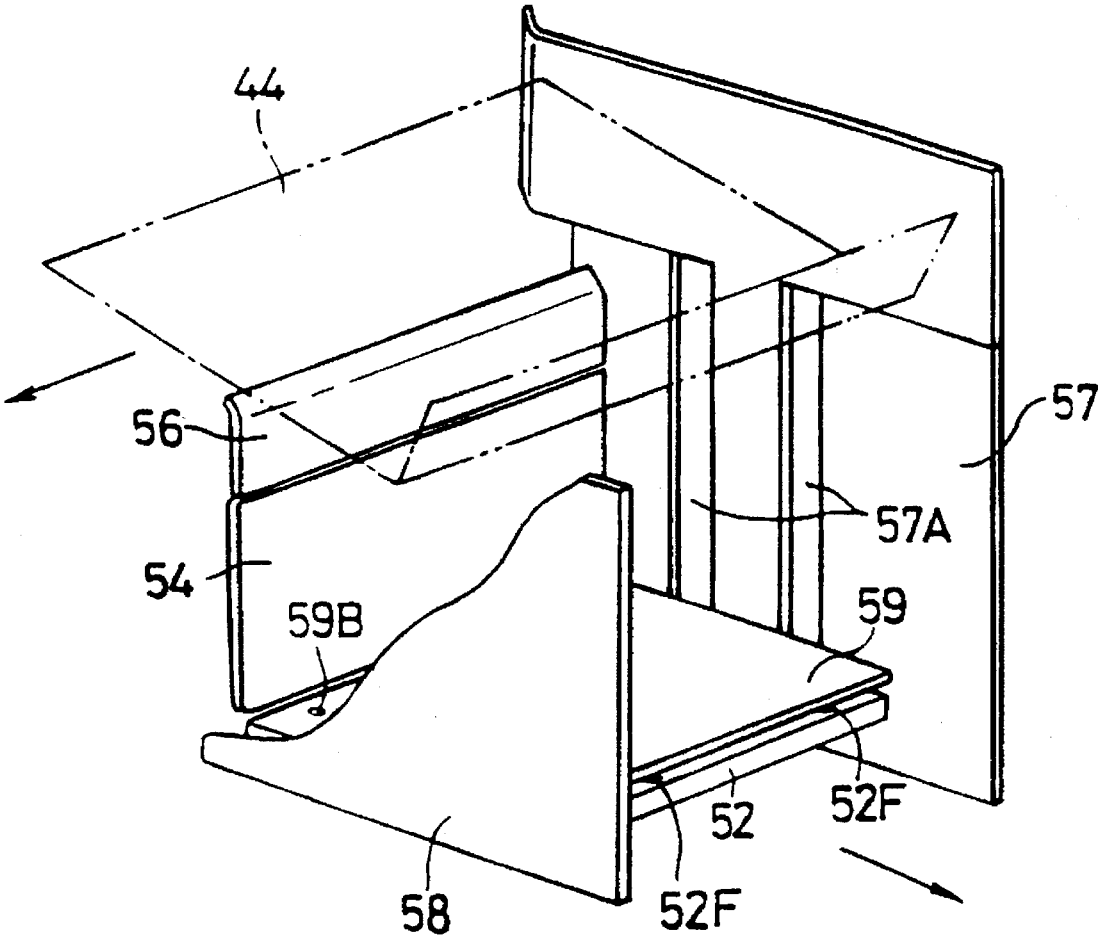
FIG. 5 is a fragmentary perspective view showing a collection form deformation prevention wall provided in the table unit.

In the table unit 14, as shown in FIGS. 4 and 5, collection form deformation prevention walls 56 to 58 are provided on three of all the four sides enclosing the space of vertical movement of the stacking table 52 and the slide 59 other than the front side facing the container 17. The deformation prevention wall 56 is set to be flush with the goods return prevention member 54. The deformation prevention wall 57 on the side of the lift guide 51 has a slit 57A, through which the table support member 52C is passed. Goods 1 which have been aligned in both the X and Y directions on the shutter 13, can be stacked the slide 59 on the stacking table 52 of the table unit 14 and lowered down into the container 17 without deformation of their collection form because during this time, their three sides are enclosed by the collection form deformation prevention walls 56 to 58 and goods return prevention member 54. The form of the collected goods 1, one side of which faces the container 17 and on which no collection form deformation prevention wall is provided, has been aligned on the shutter 13 by the stopper 44A, and thus it is not easily deformed.

(E) Container conveyor 15 (FIGS. 1 and 3)

The container conveyor 15 can convey containers 17 on a roller conveyor 62 provided on a rack 61. Designated at 63 is a roller drive belt. The roller conveyor 62 has its conveying surface inclined downward (with an inclination angle α) toward the table unit 14, and container guide rollers 64 are provided at the lower end of the slope of inclination of the container. Each container 17 thus is conveyor with its bottom placed on the roller conveyor 62 and the lower edge of one of its sides is guided by the container guide rollers 64.

The container conveyor 15 includes a container turn-down mechanism 65, which is provided at a container turn-down position facing the front of the table unit 14. The container turn-down mechanism 65 has a container support arm 66 pivoted to the rack 61 for rotation by 90- α degrees (α at being the inclination angle of the conveyor 62) and a piston-cylinder assembly 67 for causing the rotation of the support arm 66. In the container turn-down mechanism 65, the container support arm 66, in its state supporting the bottom and one side of a container 17 at the container turn-down position, is rotated by a 90- α degrees to bring the container 17 to a goods accommodation position, at which the horizontal opening of the container 17 faces stacked goods on the slide 59 on the stacking table 52. The container 17, which is at the horizontal goods accommodation position, has the inner surface of its lower side wall set at the same level as the slide 59 on the stacking table 52 at the lower set position.

When the container is brought to its horizontal goods accommodation position, the goods stacked on the slide 59 on the stacking table 52 are moved into the container 17 by the slide drive piston cylinder assembly 60 of the table unit 14. Subsequently, the container 17 is returned onto the roller conveyor 62 by a returning operation of the container turn-down mechanism 65 and is then conveyed.

Now, a method of assigning goods receptacles 34 and containers 17 for individual customers with respect to all kinds of ordered goods handled by the goods collection apparatus 10, will be described with respect to FIGS. 14A to 16 and Tables 1 to 3.

The total number of order cases is denoted by K with each individual customer being assigned their own letter k. The number of different kinds of goods ordered by customer No. k is denote by F (goods kind No. f), the depth of the container 17 by Wc, and the height of the container 17 by Hc, as illustrated in FIG. 14B. The assignment number of container 17 is denoted by m, and the assignment number of goods receptacle 34 by i. It is assumed that the width Lc of container 17 is set to be greater than the width of goods delivered to goods receptacle 34.

The quantity of goods of goods kind No. f to be delivered to customer No. k is denoted by P, the quantity of goods in one row of goods kind No. f in the cardboard box 16 by n, the depth of goods in one row of goods kind No. f on goods receptacle 34 by w, and the height of goods in one row of goods kind No. f on goods receptacle 34 by h.

The maximum number of goods receptacles assigned to customer No. k is denoted by $i_{max}$, and the maximum height of goods on each goods receptacle 34 (No. i) by $h_{max}(i)$.

It is assumed that in the total number K of order cases, the goods kind No. f and the quantity P of goods of that kind are predetermined for customer No. k as in Table 1. In this situation, the number (i) of goods receptacles used, the number (j) of rows of goods assigned to the individual goods receptacles (No. i) and the number (m) of containers used are calculated for customer No. k. containers used are calculated for customer No. k.

TABLE 1

Order Contents (total customers: K = 3)

| (k) | (f) | Name of Goods | Quantity (P) | Number of kinds ordered goods (F) |
|---|---|---|---|---|
| Customer | 1 | A | 3 | 2 |
| No. 1 | 2 | C | 8 | |
| Customer | 1 | B | 5 | 2 |
| No. 2 | 2 | C | 5 | |
| Customer | 1 | A | 6 | 3 |
| No. 3 | 2 | B | 8 | |
| | 3 | C | 6 | |

Table 2 shows the result of these assignment calculations.

TABLE 2

Assignment Calculation Results

| (k) | Goods Receptacle (i) | Assigned row (j) | Container (m) |
|---|---|---|---|
| Customer | 1 | Goods A: 1 row (3) | 1 |
| No. 1 | | Goods C: 2 row (8) | |
| Customer | 1 | Goods B: 2 row (5) | 2 |
| No. 2 | | Goods C: 1 row (4) | |
| | | Goods C: 1 row (1) | |
| Customer | 1 | Goods A: 1 row (4) | 3 |
| No. 3 | | Goods B: 1 row (4) | |
| | 2 | Goods A: 1 row (2) | |
| | | Goods B: 1 row (4) | |
| | 3 | Goods C: 2 row (6) | 4 |

The quantity n of goods in one row in the cardboard box 16 with respect to good kind No. f and the depth w and height h are given as shown in Table 3.

TABLE 3

Specification of Goods

| | Quantity (n) of one row | Depth (w) | Height (h) |
|---|---|---|---|
| Goods A | 4 | 160 | 155 |
| Goods B | 4 | 110 | 155 |
| Goods C | 4 | 60 | 60 |

(A) Overall Assignment Calculation Routine (FIG. 14A)

(S1 ) The calculation is made first with respect to the first customer (k=1). At this time, containers are assigned from the first container (m=1) for the first customer.

(S2) For all the goods receptacles 34 (i), the depth W(i) thereof is set to the depth Wc of container 17 (W(i)=Wc).

While in this instance the depth of goods receptacle is set to be equal to the depth of container, it is also possible to set the depth of goods receptacle to be greater than the depth of container. By so doing, more goods can be accommodated in container 17.

(S3) Calculation is made first for the first goods kind (f=1) with respect to customer No. k.

(S4) Calculation is made first for the first goods receptacle 34 (i =1). Also, $i_{max}$ (the maximum number of goods) is set equal to one.

(S5) The number (i) of goods receptacles 34 used and the number (j) of rows of goods assigned to the pertinent goods receptacle 34 (No. i) are calculated in the assignment calculation routine (B) (FIG. 15) described below.

The calculation in (S5) above is repeatedly made for all kinds (f=F) of goods with respect to customer No. k by looping through steps S6, S7, S4 and S5 as necessary.

(S8) On the basis of the result of calculation in the loop S4–S7 above, the number (m) of containers 17, in which the goods received by the goods receptacles 34 (No. i) assigned to customer No. k are stackedly accommodated, is calculated in the assignment calculation routine (C) (FIG. 16) described below. The calculation in (S8) above is made repeatedly for all order cases K using the loop of S2–S10.

(B) Calculation For Assignment to Goods Receptacle. (Calculation of the number of goods receptacles 34 assigned to customer No. k (FIG. 15)).

(T1) The number R of rows of goods of goods kind No. f assigned to the goods receptacles 34 is calculated for the quantity P of goods of goods kind No. f with aspect to customer No. k and the quantity n of goods in one row of goods kind No. f in cardboard box 16 (R=P/n). The fraction of the result of calculation is rounded up.

(T2) Initially, a check is made as to whether an assignment can be done from the first row (j=1).

(T3) The remaining depth W(i) of goods receptacle 34 and the depth w of one row of goods are compared.

(T5) If the depth w is smaller (i.e. the answer in step 73 is yes), the row No. j of goods is assigned to the pertinent goods receptacle 34. At this time, the remaining depth W(i) of goods receptacle 34 is calculated, and the old remaining depth W(i) is updated. Further, the maximum height $h_{max}(i)$ of goods 1 assigned to this goods receptacle 34 is stored.

(T4) If it is found in (T3) above the depth w is greater, the row No. j of goods is assigned to the succeeding goods receptacle 34 (No. i+1) in step T4. At this time, the maximum number $i_{max}$ of goods receptacles 34 used for customer No. k is stored.

The preceding steps are executed repeatedly for all the number R of rows of goods of goods kind No. f using the loop containing steps T3–T7.

While in this instance a check as to whether goods can be received on the goods receptacle 34 is done for every row of goods in the cardboard box 16, it is also possible to make the check for every goods kind. In this case, a comparison W(i)>w×R is made in the steps (T3) and (T4) outlined above.

(C) Stack Calculation. (Calculation of the number of containers 17 to be assigned to customer No. k (FIG. 16))

(U1) Calculation is made first with the first goods receptacle 34 (i=1) among the goods receptacles 34 assigned in (B) and with the first container 17 (m=1).

(U2) The height of the container 17 (No. m) is set to Hc.

Figure 15:
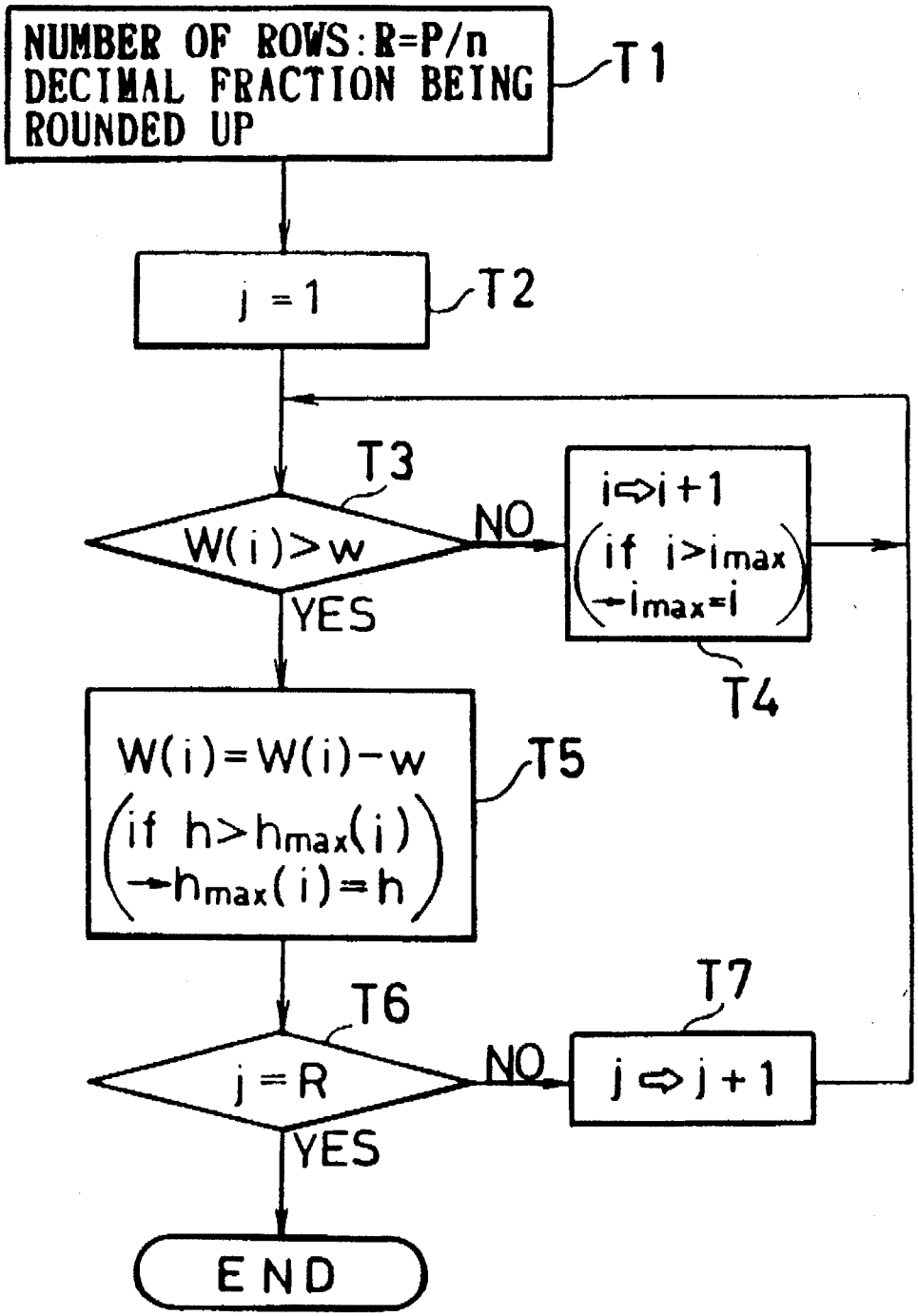
FIG. 15 is a flow chart of a routine for the assignment of goods receptacles to the individual customers.
Figure 16:
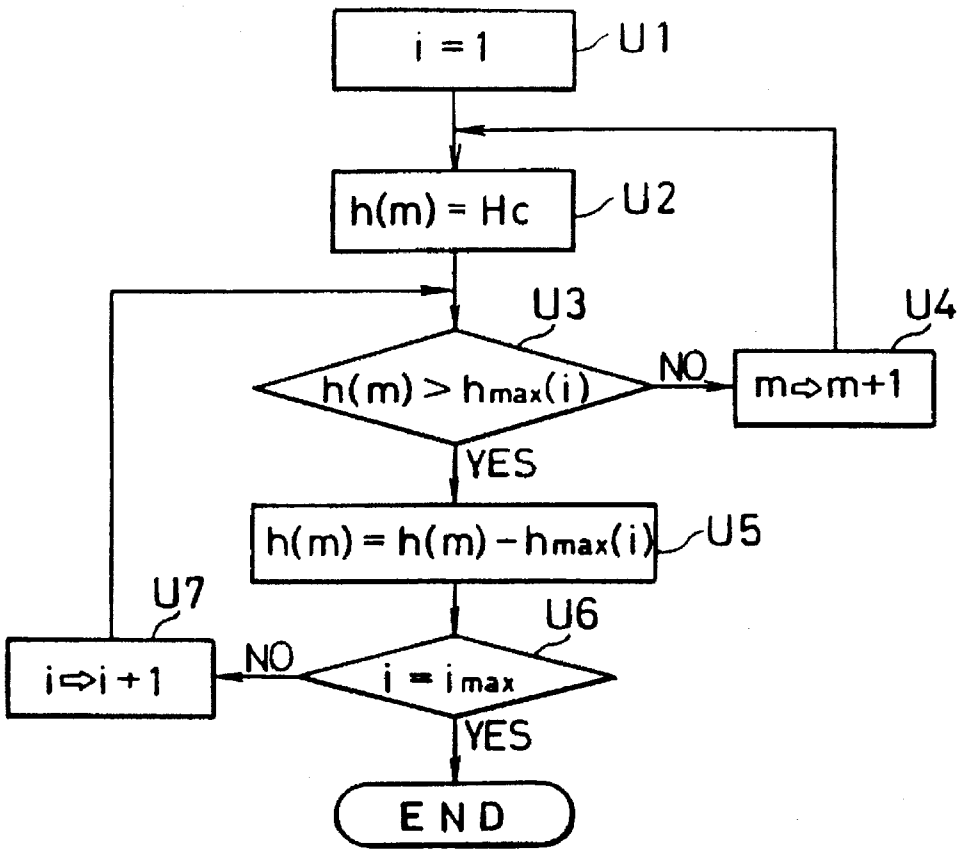
FIG. 16 is a flow chart of a routine for the assignment of containers to the individual customers.

(U3) The remaining height h(m) of the container 17 (No. m) and the maximum height $h_{max}(i)$ of goods on goods receptacle 34 (No. i) stored in step T5 in FIG. 15 are compared, and if the remaining height h(m) of the container 17 (No. m) is greater, the goods on the goods receptacle 34 (No. i) is assigned to the container 17 (No. m).

The previous step is executed repeatedly for all the number $i_{max}$ of goods receptacles 34 used in customer No. k as stored in step T4 in FIG. 15 using the loop containing steps U2, U3 and U4.

(U4) If it is found that the remaining height h(m) of the container 17 (No. m) is smaller, the goods on the pertinent goods receptacle 34 (No. i) is assigned to the next container 17 (No. m+1) and the loop of steps U5, U6, U7 and U3 is performed.

Now, the operation of goods collection in the goods collection apparatus 10 will be described.

Figure 6A:
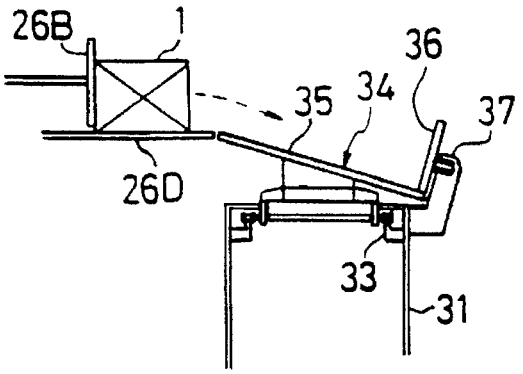
FIGS. 6A and 6B are views illustrating a step of transferring goods from the goods delivery unit to a goods receptacle.
Figure 6B:
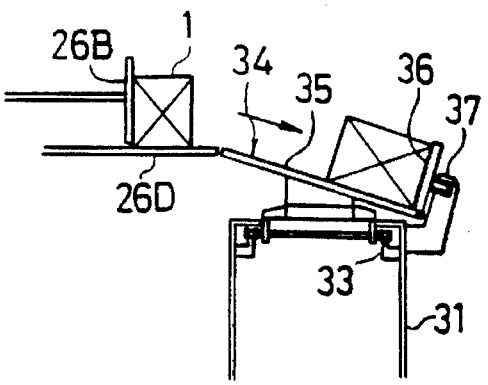

(1) Collecting Goods (FIGS. 6A and 6B)

(A) Each goods delivery unit 11 is given an instruction about the necessary quantity of goods as ordered by a delivery controller (computer) and, when a goods receptacle 34 on the goods reception conveyor 12 is stopped in front of its goods delivery table 26D, it delivers goods 1 in an arrangement of a row to the goods receptacle 34 (FIG. 6A).

(B) Goods I delivered from the delivery table 26D of the goods delivery unit 11 are received on the goods reception surface 35 of the goods receptacle 34, which is inclined downward from the goods reception side adjacent the delivery table 26D. The received goods 1 slide over the goods reception surface 35 strike and are stopped by the movable side wall 36 in the closed state while maintaining their state of arrangement in a row (FIG. 6B).

(C) The goods receptacle 34 is conveyed on the conveyor 12 to successively reach the front of other goods delivery units 11 to receive goods 1 of other kinds which are delivered likewise from the other goods delivery units 11. These goods 1 received on the goods reception surface 35 are caused to gather against the movable side wall 36 and are thus given a predetermined collection form (FIG. 6B).

Figure 7A:
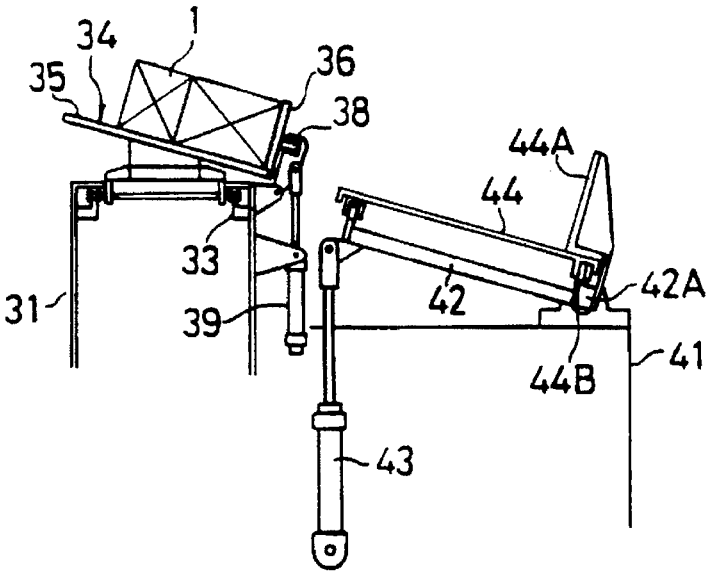
FIGS. 7A and 7B are views illustrating a step of transferring a first layer of goods from the receptacle to the shutter.
Figure 7B:
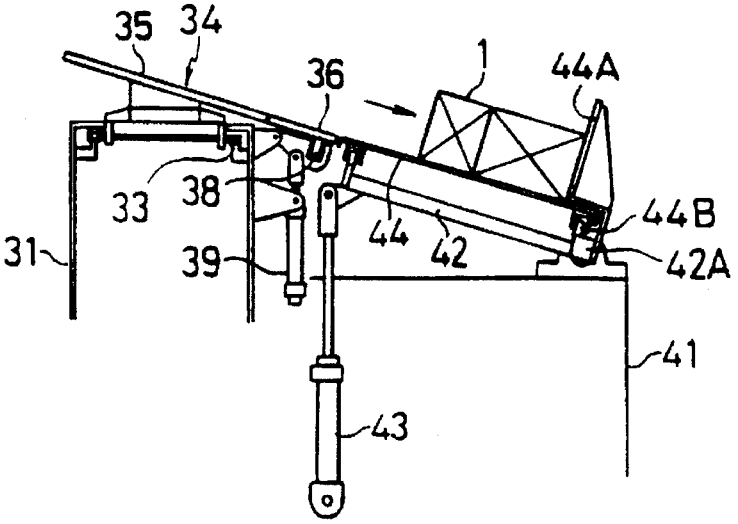

(2) Transferring Goods (FIGS. 7A and 7B)

When the goods receptacle 34 arrives at the goods delivery position at the end of the conveying line of the conveyor 12, the movable side wall 36 is opened and tilted to the same angle as the goods reception surface 35. Thus, the goods on the goods reception surface 35 slide onto the shutter member 44 of the shutter 13 having waited in the inclined state substantially at the same angle as the goods reception surface 35 to be stopped and received by the stopper 44A (FIGS. 7A and 7B).

The inclination angle of the goods reception surface 35 and shutter member 44 is preferably as large as possible in a range, in which goods 1 are not damaged when they strike the movable side wall 36 or stopper 44A. If the inclination angle of the goods reception surface 35 and shutter member 44 is small, goods 1 may tumble while they, are sliding and thus get out of the collection form.

(3) Stacking Goods (FIGS. 8A to 8C and 9A to 9C)

Figure 8A:
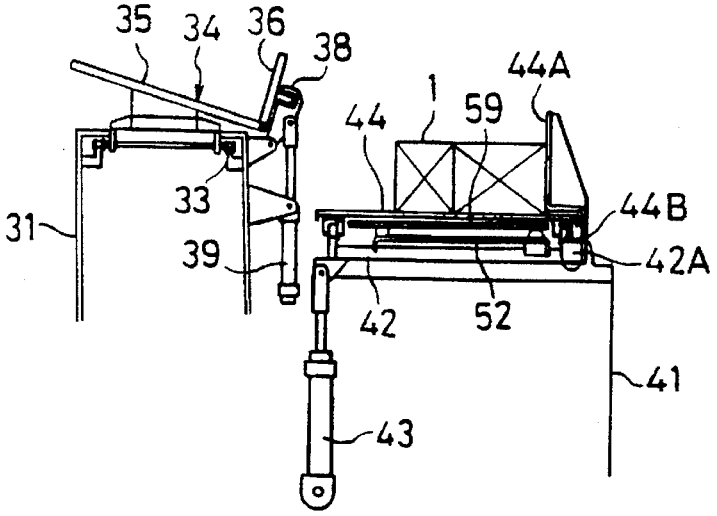
FIGS. 8A to 8C are views illustrating a step of transferring a first layer of goods from the shutter to the table unit.
Figure 8B:
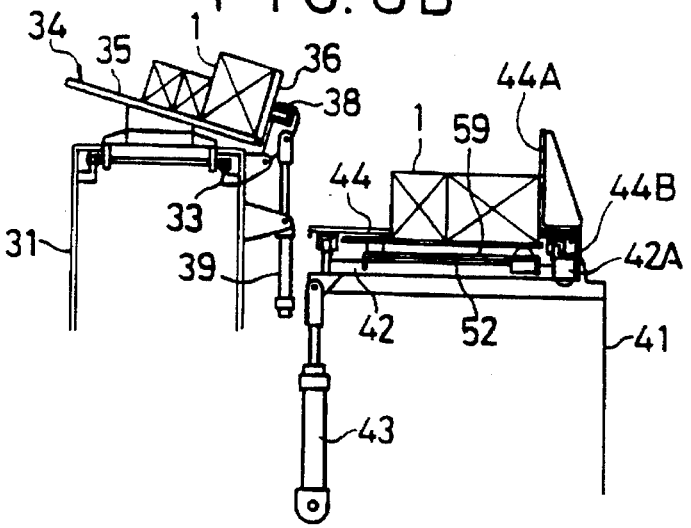

(A) In the shutter 13, after the shutter member 44 in the tilted position receives the goods 1 as described before, it is brought to the horizontal position and opened, whereby the goods 1 is transferred onto the slide 59 on the stacking table 52 of the table unit 14 (FIGS. 8A and 8B).

At this time, the stacking table 52 and the slide 59 are waiting in its upper set position free from interference with the lower surface of the shutter member 44.

Figure 8C:
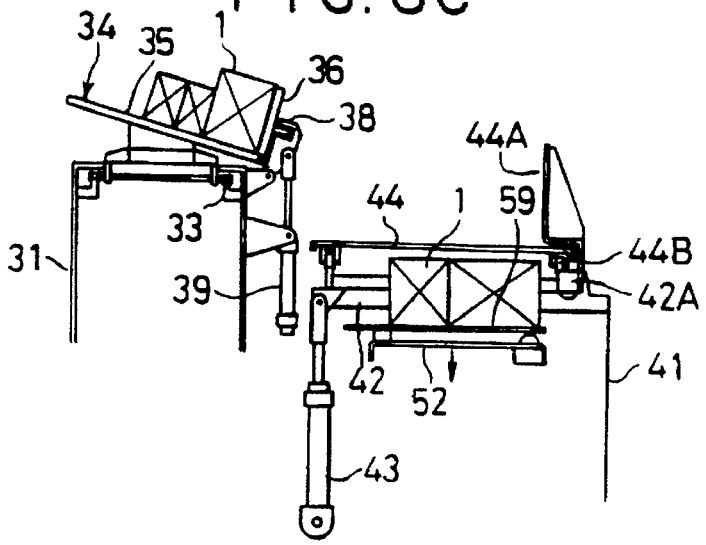

(B) The slide table 59 on the stacking table 52 is then lowered until the uppermost surface of the goods 1 on it is detected by the optical sensor 53 (FIG. 8C).

Figure 9A:
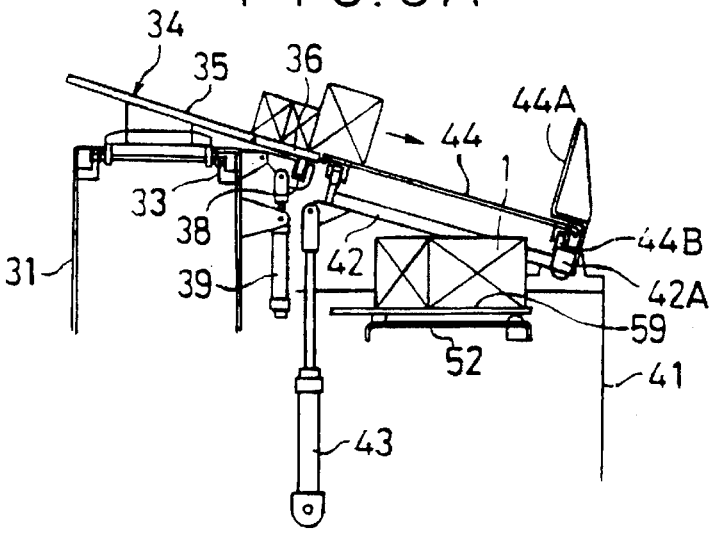
FIGS. 9A to 9C are views illustrating a step of transferring a second layer of goods from the goods receptacle to the shutter and thence to the table unit.
Figure 9B:
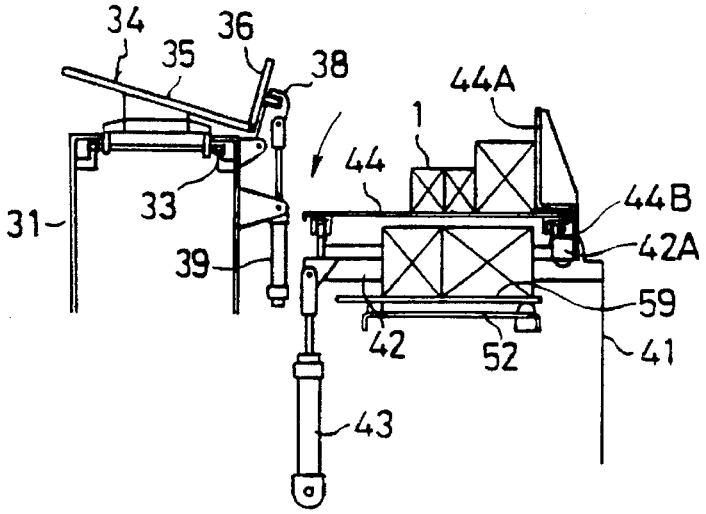
Figure 9C:
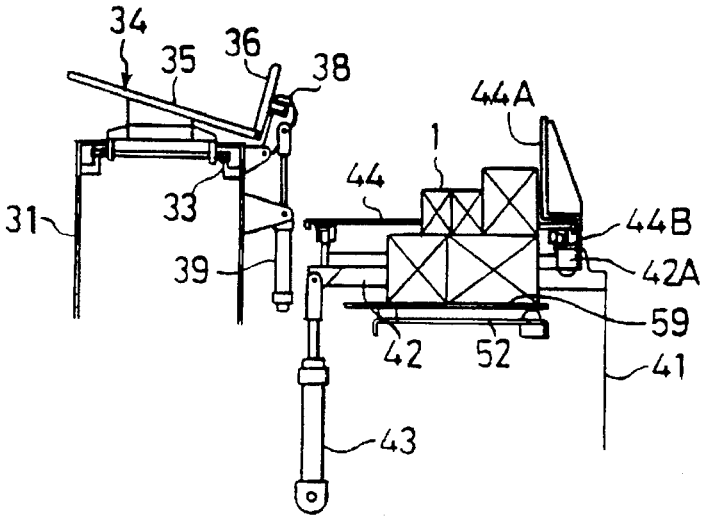

(C) The shutter member 44 is then closed and tilted again. In this way, the reception of goods on the shutter member 44 in (2) and the transfer of the goods onto the slide 59 on the stacking table 52 in (3), (1) and (2) are repeatedly carried out, thus forming on the slide 59 on the stacking table 52 a collection form of goods to be accommodated in the container 17 (FIGS. 9A to 9C).

The goods 1 on the goods receptacle 34 in FIGS. 8B and 8C form a second layer of stack on the slide 59 on the stacking table 52. The goods 1 stacked on the slide 59 on the stacking table 52, either in the first layer or the second, have one side defined by the same stopper 44A. That is, the individual layers of goods 1 are aligned by the stopper 44A as the same reference of alignment, and thus the aligned surfaces of the upper and lower layers of goods 1 are flush with each other.

(4) Accommodating Goods (FIGS. 10A, 10B, 11A and 11B)

(A) When a collection form of a predetermined number of vertical layers of goods is formed on the slide 59 on the stacking table 52 of the table unit 14, the stacking table 52 is lowered to the lower set position as the level of accommodation of goods into the container 17. At this time, the collection form of the goods is not deformed because the stacking table 52 and the slide 59 have their three sides enclosed by the collection form deformation prevention walls 56 to 58 and the goods return prevention member 54. On the side of the stacking table 52, on which an opening for delivering goods into the container 17 is formed and no collection form deformation prevention wall is provided, the goods are aligned accurately by the stopper 44A, and the aligned collection form is not easily deformed FIG. 10A).

Figure 10A:
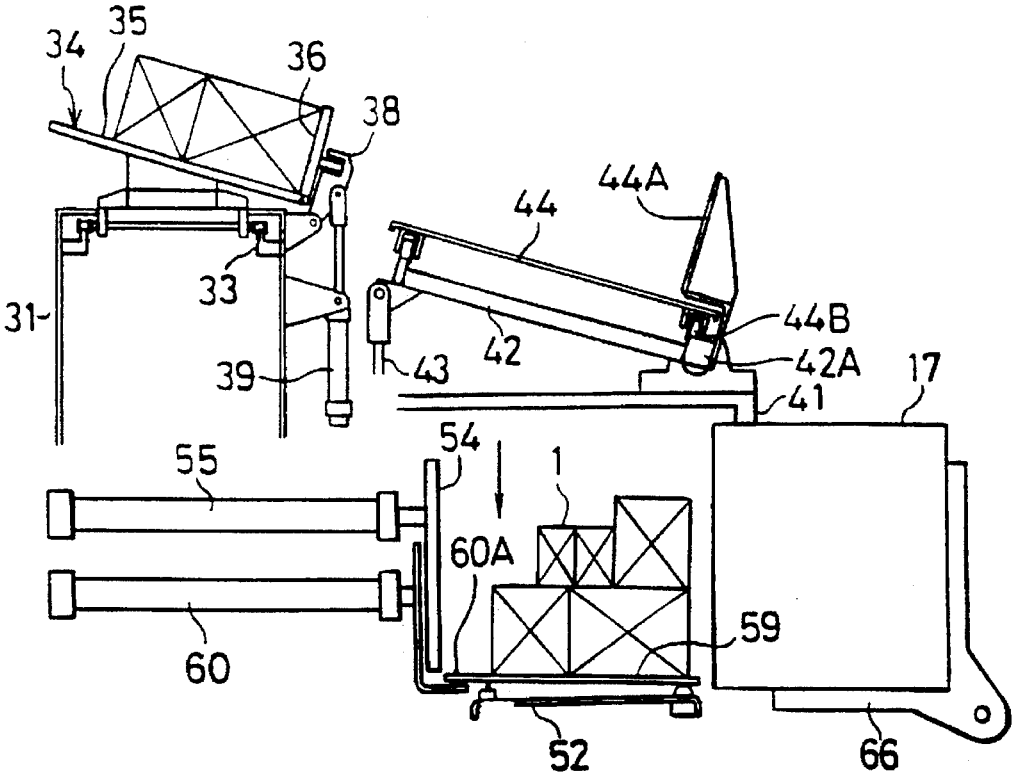
FIGS. 10A and 10B are views illustrating a step of transferring goods from the table unit to a container.

(B) The conveyor 17 is conveyed on the roller conveyor 62 of the container conveyor 15 and, when it arrives at the container turn-down position and comes to face the table unit 14, it is turned down by the container turn-down mechanism 65 horizontally such that its opening is directed toward the stacking table 52 and that its lowermost surface is set to the same level as the slide 59 on the stacking table 52 (FIG. 10A).

Figure 10B:
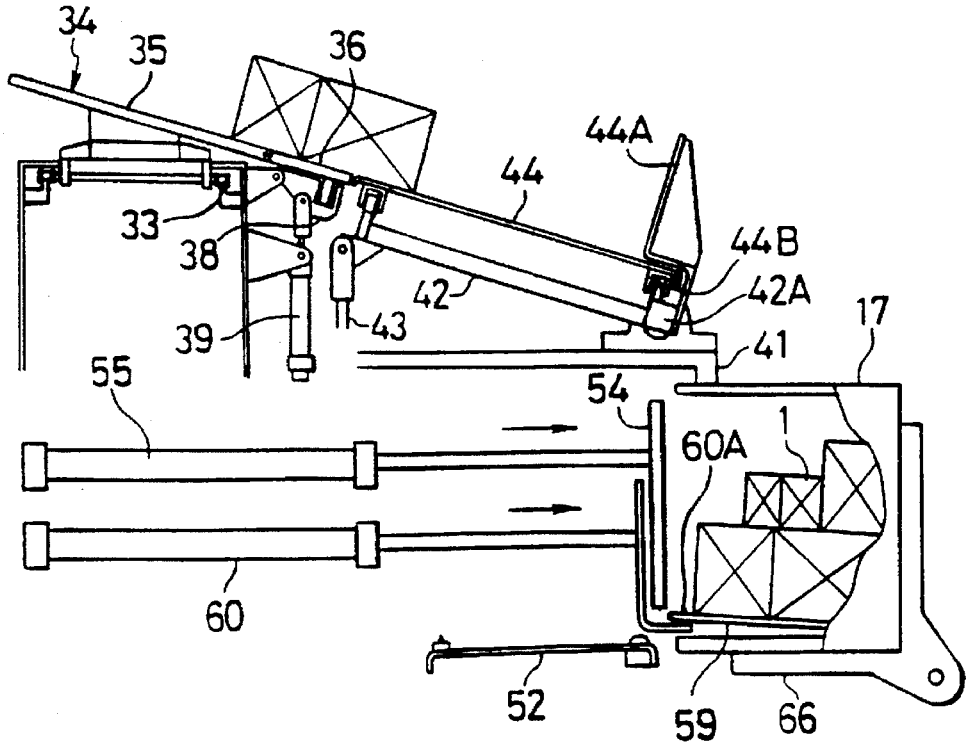

(C) The slide 59 with the goods 1 stacked thereon is then inserted together with the goods 1 into the container 17 by the slide drive piston-cylinder assembly 60 (FIG. 10B). Since at this time container side surfaces of the stacked goods are aligned by the stopper 44A, all the stages of goods on the slide 59 are inserted into close proximity of the bottom of the container 17. The stacked goods are inserted comparatively slowly so that they can be inserted without being collapsed or otherwise deformed. The goods return Prevention member 54 is moved toward the container 17 by the goods return prevention drive piston-cylinder assembly 55.

Figure 11A:
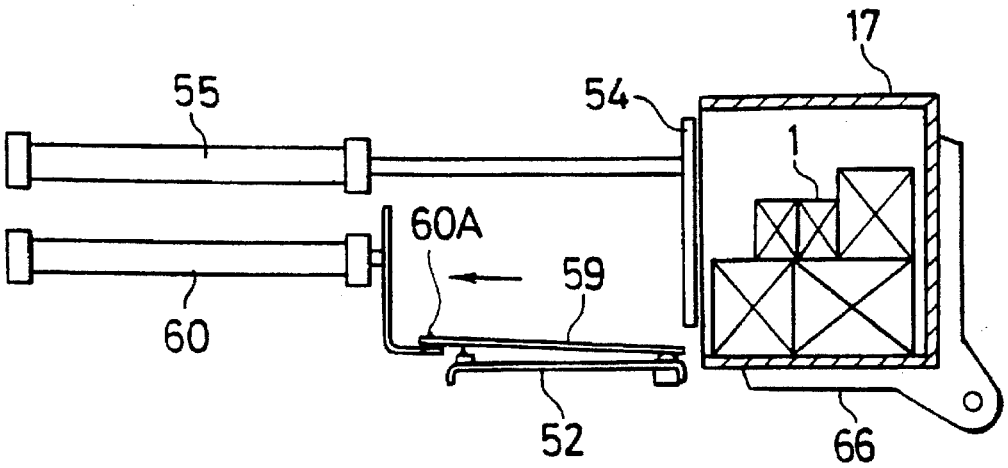
FIGS. 11A and 11B are schematic views illustrating a step of transferring goods from table unit to a container.

(D) The slide drive piston-cylinder assembly 60 quickly pulls the slide 59 out of the container 17 to leave the stacked goods alone in the container 17 (FIG. 11A). The slide 59 is pulled out at a higher speed than the speed of its insertion lest it should be pulled out together with the stacked goods. Usually, the pulled-out speed is 300 to 500 mm/sec., and in this embodiment, it is set to 500 mm/sec. The goods return prevention member 54 checks the goods such that the goods will not get out of the container 17 even when the goods get out of the orderly form.

Figure 11B:
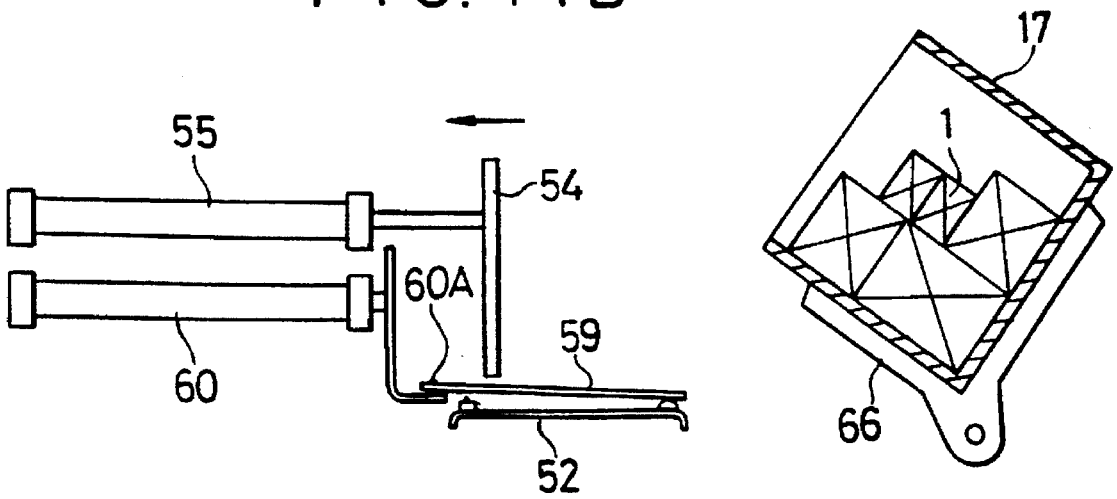

(E) The container 17 is returned by the container position change unit 65 to the roller conveyor 62 to be conveyed out (FIG. 11B). The slide 59 is returned to the retreated position (i.e., initial position) by the slide drive piston-cylinder assembly 60, and the goods return prevention member 54 is returned to the retreated position (i.e., initial position) by the goods return prevention member drive piston-cylinder assembly 55.

The functions of this embodiment will now be described.

Figure 17A:
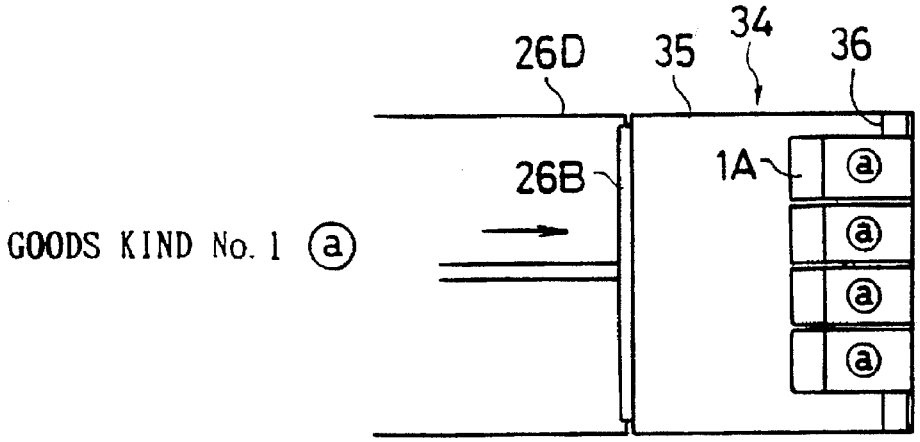
FIGS. 17A to 17C are schematic views illustrating a method of collecting goods on a goods receptacle according to the invention.
Figure 17B:
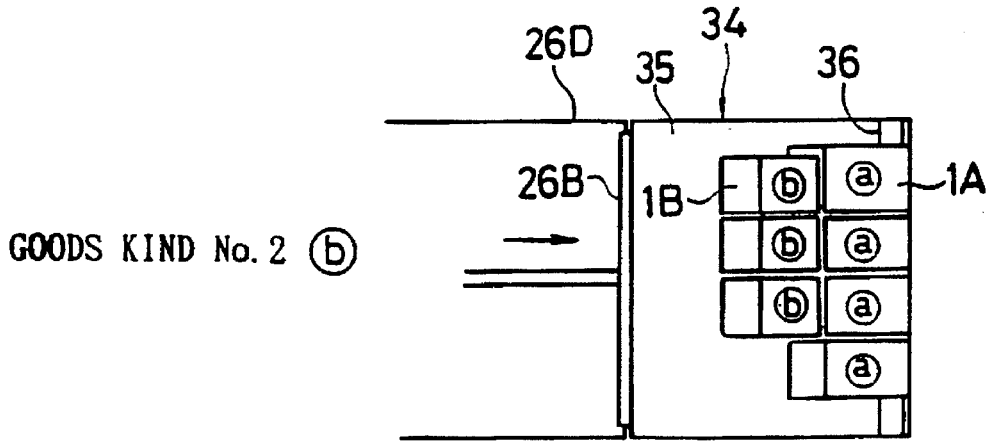

(1) Goods 1A (or 1B) delivered from the goods delivery unit 11 and first transferred onto the goods receptacle 34 slide along the slope of the goods reception surface 35, and at the lower end of the inclined goods reception surface 35, they are received in a predetermined collection form with one side thereof defined by the movable side wall 36 in the closed state (FIGS. 17A and 17B).

Figure 17C:
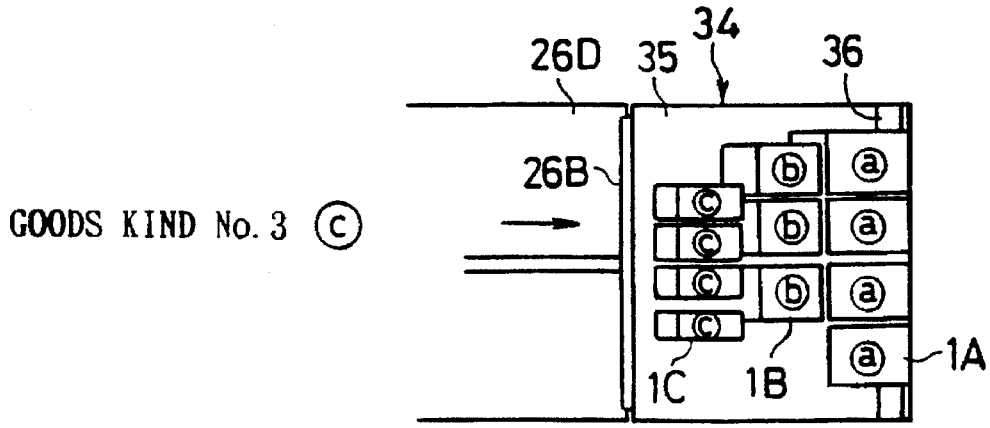

Succeeding goods 1B (or 1C) also slide along the slope of the goods reception surface 35, and on the side of the lower end of the inclined goods reception surface 35, they are received in a predetermined collection form with one side thereof defined by the corresponding side of the goods 1A (or 1B) which have already been held stationary in the predetermined collection form as noted above (FIGS. 17B and 17C).

Thus, the successively transferred goods are stably collected such that they are allowed to gather on the side of the movable side wall 36. That is, it is possible to high densely collect goods on the goods reception surface in a predetermined collection form.

Figure 18A:
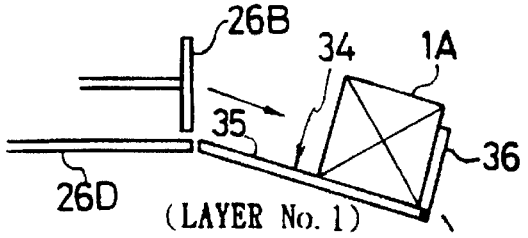
FIGS. 18A to 18E are schematic views illustrating a method of collecting goods in a container according to the invention.
Figure 18B:
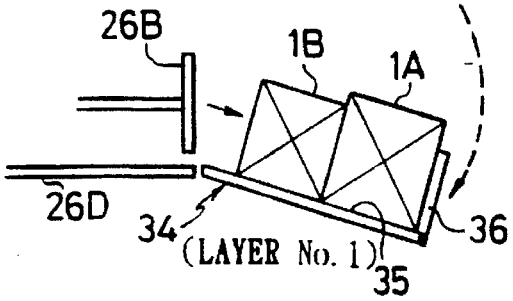
Figure 18C:
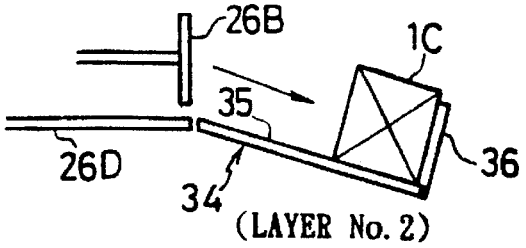

(2) When successively transferring goods 1 delivered from the goods delivery unit 11 onto two or more goods receptacles 34 and then accommodating the goods 1 on each goods receptacle 34 into a corresponding container 17, goods 1A and 1B, for instance, are highly densely collected on the first goods receptacle 34A in (1), and then goods 1C are highly densely collected on the second goods receptacle 34B in (1) (FIGS. 18A to 18C).

Figure 18D:
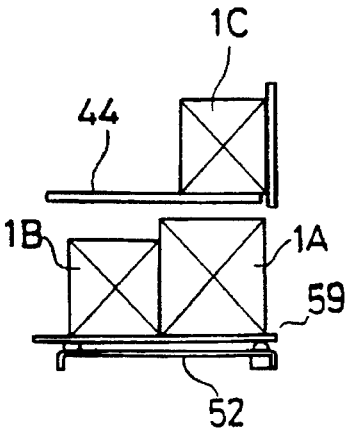

Subsequently, the movable side wall 36 of the first goods receptacle 34A is opened, whereby the goods 1A and 1B collected thereon in the predetermined collection form are transferred without deformation of the predetermined collection form from the inclined goods receptacle 35 onto the shutter member 44 with substantially the same slope of inclination. Thereafter, the shutter member 44 is brought to the horizontal position and then opened, whereby the goods 1A and 1B are transferred in the predetermined collection form onto the stacking table 52 (FIG. 18D).

Figure 18E:
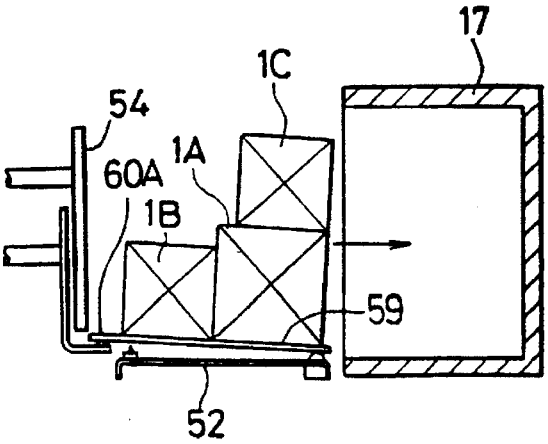

Then, the movable side wall 36 of the second goods receptacle 34B is opened, whereby the goods 1C collected thereon in the predetermined collection form are transferred without deformation of the collection form from the inclined goods collection surface 35 onto the shutter member 44 with substantially the same slope of inclination. Thereafter, the shutter member 44 is brought to the horizontal position and then opened, whereby the goods 1C are transferred in the predetermined collection form onto and stacked on the goods 1A and 1B which have already been transferred onto the stacking table 52 (FIGS. 18D and 18E). At this time, the goods 1C can be stacked without deformation of the collection form on the goods 1A and 1B, because the lower goods 1A and 1B are arranged without an intervening gap between adjacent ones of them.

The goods 1A to 1C which have thus been stacked on the stacking table 52, are pushed into and accommodated in the container 17 by the pusher plate 54 (FIG. 18E).

Thus, a plurality of different kinds of goods can be accommodated in a stacked state in the container without deformation of the predetermined collection form. In other words, they can be highly densely stacked in the container.

(3) The movable side wall 36 of the goods receptacle 34 and the scraper 47 of the shutter 13 are disposed such as to stop and receive perpendicular sides of the goods 1. More specifically, when the goods 1 are received on the goods reception surface 35 of the goods receptacle 34, their Y direction position is regulated with one side of them defined by the movable side wall 36. Then, when the goods are subsequently delivered from the shutter member 44 of the shutter 13, their Y direction position is regulated with a different side of them pushed by the scraper 47. In consequence, the goods are delivered in a form aligned in both the X and Y directions to the side of the table unit 14.

Figure 20A:
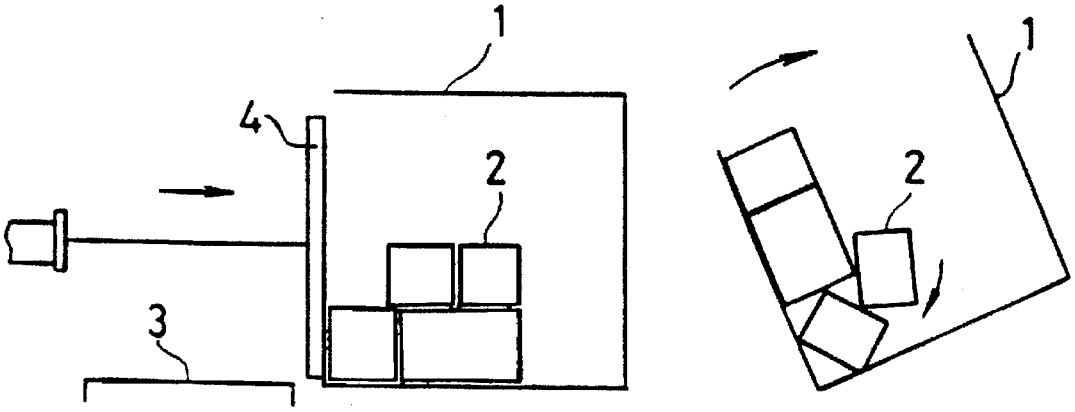
FIGS. 20A and 20B are schematic views comparing the method according to the invention to a prior art method.
Figure 20B:
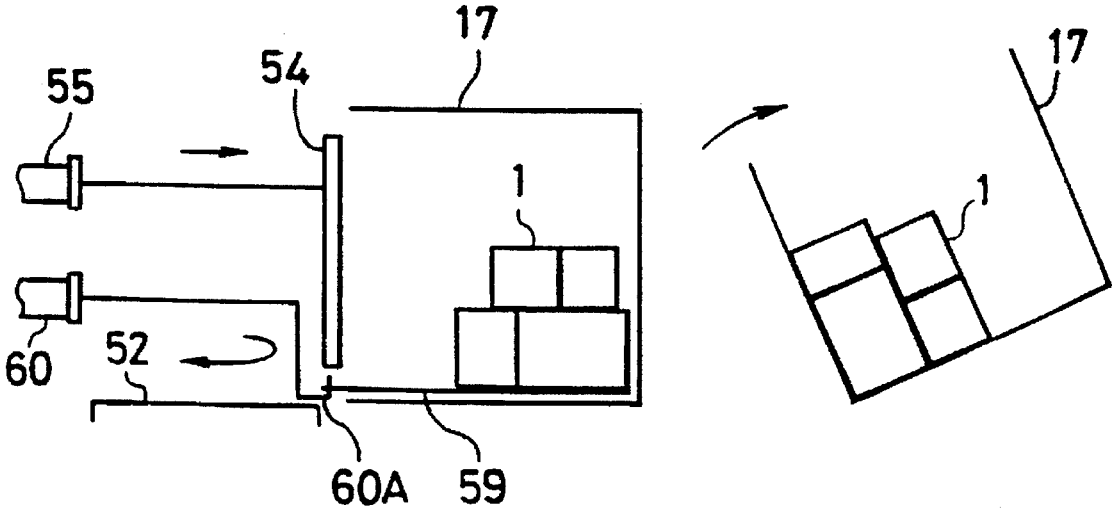

(4) After the goods 1 have been stacked on the slide 59, they are inserted together with the slide 59 into the container 17, i.e., to the vicinity of the container bottom, and then the slide 59 alone is pulled out with the goods remaining in the container. In this way, the goods are transferred to the vicinity of the bottom of the container 17 while holding their stacked state. Since the goods at this time are stacked with their surfaces on the side of the bottom of the container 17 aligned, all the stages of goods are brought to a position in the vicinity of the bottom of the container 17. Thus, when the container 17 is turned up, the goods in all the stages are immediately supported on the bottom of the container 17 such that they are left on the bottom. That is, they are not deformed from the stacked state with their surfaces on the side of the container bottom aligned. This allows the stacked goods to be accommodated in the container 17 without deformation of the stacked state (FIG. 20B).

(5) With the slide 59 inclined downward toward the inside of the container 17, when the slide 59 is pulled out of the container 17, the goods 1 can be readily separated from the slide 59 to remain on the side of the bottom of the container 17. It is thus possible to prevent the goods 1 from being pulled out together with the slide 59 out of the container 17.

(6) By using the goods return prevention member 54, which blocks the opening of the container 17 when the slide 59 is moved out of the container 17, the goods 1 are prevented from being pulled out of the container 17. This is particularly effective when the quantity of goods are large.

While one embodiment of the invention has been described in detail with reference to the drawings, the described specific construction of the embodiment is by no means limitative, and design changes and modifications without departing from the scope of the invention are covered in the invention.

Although the invention has been illustrated and described with respect to several exemplary embodiments thereof, it should be understood by those skilled in the art that the foregoing and various other changes, omissions and additions may be made to the present invention without departing from the spirit and scope thereof. Therefore, the present invention should not be understood as limited to the specific embodiment set out above but to include all possible embodiments which can be embodied within a scope encompassed and equivalents thereof with respect to the feature set out in the appended claims.

What is claimed as new and desired to be secured by Letters Patent of the United States is:

1. A goods accommodation method, comprising the steps of:

successively moving and positioning a plurality of goods receptacles along a conveying line at goods delivery portions of goods delivery units;

successively receiving and accommodating a required type of box-shaped goods delivered from the goods delivery portion of an ordered one of the goods delivery units in requested quantities on each of the goods receptacles which have a goods reception surface inclined downward from a goods reception side towards an opposite side having a stopper wall for stopping received goods; and leaning the required type of goods against the stopper wall, thereby causing the required kind of goods received on the goods receptacle to gather on the goods reception surface at the side of the stopper wall on the inclined goods reception surface and holding the goods in a delivery state.

2. A method according to claim 1, further comprising the steps of:

conveying the required type of goods on the inclined surface of one of the goods receptacles to a table unit; and pushing the required type of goods from the table unit into a container through a horizontal opening in the container.

3. A method according to claim 2, further comprising the step of:

rotating the container containing the required type of goods so that the opening faces upward, after the pushing step.

4. A method according to claim 3, further comprising the step of:

transporting the container having the opening thereof facing upward along a conveyor.

5. A method according to claim 2, further comprising the step of:

lowering the table unit from a position at which the required type of goods are received from the one of the goods receptacles to a position which is aligned with the container, after the goods are conveyed to the table unit and before the goods are pushed in the container.

6. A method according to claim 5, further comprising the step of:

rotating the container containing the required type of goods so that the opening faces upward, after the pushing step.

7. A method according to claim 1, wherein:

the step of moving and positioning comprises moving and positioning the plurality of goods receptacles along a conveying line at the goods delivery positions of the goods delivery units which are in parallel.

8. A goods accommodation system, comprising:

goods delivery units provided at a plurality of goods delivery portions along a conveying line; and a plurality of goods receptacles which can be successively moved and positioned at the goods delivery portion of each of the goods delivery units, each of the goods receptacles having a goods reception surface inclined downward from a goods reception side towards an opposite side which has a stopper wall for stopping the received goods; and a controller for controlling a delivery of a requested type of box-shaped goods in requested quantities from the goods delivery units to the plurality of goods receptacles.

9. A system according to claim 8, further comprising:

a table unit which receives the requested type of goods from the inclined surface of one of the goods receptacles; and a device which pushes the requested type of goods from the table unit into a container through a horizontal opening in the container.

10. A system according to claim 9, further comprising:

a device which rotates the container containing the requested type of goods so that the opening faces upward, after the goods are pushed in the container.

11. A system according to claim 10, further comprising:

a conveyor which transports the container having the opening thereof facing upward.

12. A system according to claim 11, further comprising:

a device which lowers the table unit from a position at which the requested type of goods are received from the one of the goods receptacles to a position which is aligned with the container, after the goods are conveyed to the table unit and before the goods are pushed in the container.

13. A system according to claim 12, further comprising:

a device which rotates the container containing the requested type of goods so that the opening faces upward, after the goods are pushed in the container.

14. A system according to claim 8, wherein:

the goods delivery units are in parallel.

* * * * *